US007204287B2

(12) United States Patent
Casaldi et al.

(10) Patent No.: US 7,204,287 B2
(45) Date of Patent: Apr. 17, 2007

(54) TRANSFER DEVICES

(75) Inventors: Heath E Casaldi, Scottsdale, AZ (US); Cory W Worth, Portland, OR (US); Adam Becker, Phoenix, AZ (US)

(73) Assignee: Xyron, Inc., Scottsdale, AZ (US)

( * ) Notice: Subject to any disclaimer, the term of this patent is extended or adjusted under 35 U.S.C. 154(b) by 190 days.

(21) Appl. No.: 10/761,221

(22) Filed: Jan. 22, 2004

(65) Prior Publication Data

US 2004/0149392 A1 Aug. 5, 2004

Related U.S. Application Data

(60) Provisional application No. 60/441,732, filed on Jan. 23, 2003.

(51) Int. Cl.
*B32B 37/26* (2006.01)

(52) U.S. Cl. ..... 156/523; 156/577; 118/76; 118/257; 206/411; 242/160.4; 242/170; 242/588.6

(58) Field of Classification Search ..... 156/540–542, 156/574, 577, 579, 584, 523, 527; 242/160.4, 242/171, 588.3, 170, 588, 588.2, 588.6; 118/76, 118/200, 257; 206/411
See application file for complete search history.

(56) References Cited

U.S. PATENT DOCUMENTS 2,845,041 A 7/1958 Karn
RE25,056 E 10/1961 Fritzinger
3,308,002 A 3/1967 Hurwich et al.
3,551,251 A 12/1970 Sato et al.
3,582,434 A 6/1971 Way
3,668,047 A 6/1972 Heller
3,745,083 A 7/1973 Aungst et al.
3,821,057 A 6/1974 Grasmann (Continued)

FOREIGN PATENT DOCUMENTS

EP 0 679 597 A2 11/1995

(Continued)

OTHER PUBLICATIONS

International Search Report for Application No. PCT/US2004/001918, dated Sep. 20, 2004.

*Primary Examiner*—Mark A. Osele
(74) *Attorney, Agent, or Firm*—Pillsbury Winthrop Shaw Pittman LLP

(57) ABSTRACT

Transfer devices are disclosed. At least one transfer device includes a housing, a supply roll rotatably mounted to the housing, a take-up roll rotatably mounted to the housing, and an application head. The supply roll has a wound supply of liner wound thereon, and the liner has an adhesive carrying surface with an adhesive provided thereon. The take-up roll has at least an end portion of the liner connected thereto such that rotation of the take-up roll in a take-up direction winds portions of the liner unwound from the supply roll onto the take-up roll. The application head includes a plurality of rollers that are rotatable about substantially parallel axes spaced apart from one another, and a closed-loop belt that is trained about the plurality of rollers to provide a transfer surface facing outwardly of the device. The rotation of the rollers enables the belt to travel around the rollers.

32 Claims, 18 Drawing Sheets

U.S. PATENT DOCUMENTS 3,869,094 A 3/1975 Weick et al.
3,969,181 A 7/1976 Seabold
RE29,335 E * 8/1977 Gates et al. ..... 156/541
4,046,613 A * 9/1977 Kucheck et al. ..... 156/249
4,116,746 A 9/1978 Hamisch, Jr.
4,239,570 A * 12/1980 Kerwin ..... 156/163
4,288,275 A 9/1981 Davis
4,294,645 A 10/1981 Figg et al.
4,336,097 A 6/1982 Van Kampen et al.
4,466,855 A 8/1984 Kashiwaba
4,486,258 A 12/1984 Schrotz et al.
4,576,311 A 3/1986 Horton et al.
4,582,558 A 4/1986 Antonson
4,610,752 A 9/1986 Arnold
D286,414 S 10/1986 Pappalardo
4,696,836 A 9/1987 Dierichs et al.
4,718,971 A 1/1988 Summers
D298,440 S 11/1988 Kida
4,849,064 A 7/1989 Manusch et al.
4,851,076 A 7/1989 Manusch et al.
4,853,068 A 8/1989 Becker
4,884,734 A 12/1989 Kahl, Jr. et al.
4,891,090 A 1/1990 Lorincz et al.
D309,755 S 8/1990 Halm
4,986,874 A 1/1991 Kawada
D319,664 S 9/1991 De Lucchi
D328,097 S 7/1992 Czech
D328,098 S 7/1992 Czech
D330,556 S 10/1992 Stires, Jr.
5,187,123 A 2/1993 Yoshida et al.
5,303,759 A 4/1994 Czech
5,310,445 A 5/1994 Tucker
5,312,501 A 5/1994 Gruber et al.
5,316,613 A 5/1994 Samuelson et al.
5,326,421 A 7/1994 Taylor
5,346,580 A 9/1994 Elges et al.
5,379,477 A 1/1995 Tamai et al.
5,430,904 A 7/1995 Ono et al.
D362,462 S 9/1995 Carlson et al.
5,462,633 A 10/1995 Manusch et al.
5,605,572 A 2/1997 Berger
5,641,378 A 6/1997 Luhman et al.
5,770,007 A 6/1998 Czech et al.
5,770,008 A 6/1998 Murphy
D396,061 S 7/1998 Thompson et al.
5,783,032 A 7/1998 O'Callaghan et al.
5,792,263 A 8/1998 Koyama et al.
5,806,713 A 9/1998 Dudley et al.
D400,585 S 11/1998 Fritz et al.
5,897,742 A 4/1999 Semmler
5,921,180 A 7/1999 Lee
6,000,455 A 12/1999 Semmler
6,176,409 B1 1/2001 Lee
D441,794 S 5/2001 Kimura
D441,795 S 5/2001 De Regt et al.
6,230,780 B1 5/2001 Rietheimer
D446,246 S 8/2001 Kimura
D447,180 S 8/2001 Stropkay et al.
6,273,169 B1 8/2001 Ono et al.
6,273,982 B1 8/2001 Semmler
D448,412 S 9/2001 Miki et al.
D448,416 S 9/2001 Kimura
6,311,753 B1 11/2001 Kawada
6,322,852 B1 11/2001 Leung
D451,959 S 12/2001 Velasquez
6,354,198 B1 3/2002 Endo
6,363,990 B1 4/2002 Kozaki
6,363,992 B1 4/2002 Semmler
6,379,461 B1 4/2002 Masumoto
D457,189 S 5/2002 Chan
6,382,291 B2 5/2002 Ronalds
6,386,416 B1 5/2002 Dunshee et al.
6,516,854 B1 * 2/2003 Tsai ..... 156/542
6,568,451 B1 5/2003 Korthauer
6,592,277 B2 7/2003 Kashiwaba et al.
6,599,363 B2 * 7/2003 Narita ..... 118/76
6,601,628 B2 8/2003 Yeh
6,730,186 B2 * 5/2004 Takahashi ..... 156/238
2001/0017185 A1 8/2001 Ronalds
2003/0062135 A1 4/2003 Takahashi

FOREIGN PATENT DOCUMENTS

EP 0 679 597 A3 3/1997
WO WO91/17108 11/1991

* cited by examiner

TRANSFER DEVICES

CROSS-REFERENCE TO RELATED APPLICATIONS

This application claims the benefit of priority from U.S. Provisional Patent Application No. 60/441,732 titled "SYSTEM AND METHOD FOR LOADING A CARTRIDGE INTO DIFFERENT TYPES OF TRANSFER DEVICES," filed on Jan. 23, 2003, the entire contents of which are herein incorporated by reference.

BACKGROUND OF THE INVENTION

1. Field of Invention

The present invention relates generally to transfer devices, including definite length transfer devices and indefinite length transfer devices.

2. Description of Related Art

It is known in the art to provide different types of adhesive transfer devices for applying adhesive from a liner to a target substrate. These devices are typically used in lieu of glue sticks or sprays, as these devices are much neater and/or easier to use. These devices can be classified into two types: (1) definite length transfer devices, and (2) indefinite length transfer devices.

A definite length transfer device applies a "spot" or definite length of adhesive to a target substrate. Such a device includes a frame configured to receive a supply roll of the adhesive coated liner and a take-up roll for winding up the spent liner, a locator, and an advancer constructed to affect rotation of the take-up and supply rolls upon actuation of the locator to advance the liner so as to position a definite length portion thereof adjacent a definite length transfer surface provided by an applicator head. This enables the definite length transfer surface of the applicator head to press the definite length portion of the liner against the target substrate and transfer the definite length of adhesive thereto. Because only a definite length is applied, the device may be repeatedly used to apply the same length of adhesive at various places on a target substrate.

An example of a definite length transfer device is disclosed in U.S. Pat. No. 5,316,613 ("the '613 patent"). The '613 patent describes a definite length transfer device that includes an actuation member and advancing means that allow the device to be pressed down on a surface and released from the surface in a stamping-like manner. When the device is released from the surface, the liner containing the adhesive is advanced by the distance of the transfer surface so that fresh adhesive is exposed and the device is ready to be stamped onto the next target surface.

An indefinite length transfer device is capable of applying an indefinite length of adhesive. Indefinite length transfer devices are commonly referred to as "runners." Such a device includes a frame configured to receive a supply roll of the adhesive coated liner and a take-up roll for winding up the spent liner. An applicator head has an indefinite length transfer surface that can engage the liner against the target substrate and transfer an indefinite length of adhesive thereto by moving the indefinite length transfer device along the target substrate to apply a length of adhesive as desired. That is, the length of adhesive applied is determined by the amount the device is moved across the target substrate. There is no predetermined length of adhesive applied, as is the case with definite length adhesive transfer devices.

The present application endeavors to provide a variety of improvements to these types of devices.

SUMMARY OF THE INVENTION

One aspect of embodiments of the invention is to provide a transfer device that includes a housing, a supply roll rotatably mounted to the housing, a take-up roll rotatably mounted to the housing, and an application head. The supply roll has a wound supply of liner wound thereon. The liner has an adhesive carrying surface with an adhesive provided thereon. The take-up roll has at least an end portion of the liner connected thereto such that rotation of the take-up roll in a take-up direction winds portions of the liner unwound from the supply roll onto the take-up roll. The application head includes a plurality of rollers that are rotatable about substantially parallel axes spaced apart from one another, and a closed-loop belt that is trained about the plurality of rollers to provide a transfer surface that faces outwardly of the device. The rotation of the rollers enable the belt to travel around the rollers. A portion of the liner between the supply roll and the take-up roll is trained over the application head with the adhesive carrying surface facing outwardly of the device. The transfer surface of the belt engages a backside surface of the liner opposite the adhesive carrying surface. The head is provided on the device to enable the adhesive to be transferred to a target substrate by engaging the adhesive carrying surface on the portion of the liner trained over the belt with the target substrate and applying pressure to bond the adhesive to the target substrate. The rotation of the take-up roll, the supply roll, and the plurality of rollers of the application head enable advancement of the liner from the supply roll to the take-up roll with the belt traveling around the rollers of the application head to facilitate movement of the liner over the application head.

Another aspect of embodiments of the invention provides a transfer device for use with a cartridge. The cartridge includes a body with a longitudinal axis, and a supply roll that is rotatably mounted to the body on the longitudinal axis. The supply roll includes a wound length of liner that has an adhesive carrying surface with an adhesive provided thereon. The cartridge also includes a take-up roll that is rotatably mounted to the body on the longitudinal axis in spaced relation to the supply roll. The take-up roll has at least an end portion of the liner connected thereto such that rotation of the take-up roll in a take-up direction winds portions of the liner unwound from the supply roll onto the take-up roll. The transfer device includes a housing that defines a cartridge receiving space, an extension member that is slidably connected to the housing for rectilinear movement relative to the housing along an extension axis, and a cartridge support that is slidably connected to the extension member for rectilinear movement relative to the extension member along the extension axis. The cartridge support is constructed to mount the cartridge thereon.

The cartridge support, the extension member, and the housing are constructed and arranged to enable the cartridge support and the extension member to be moved between (a) an extended position, wherein the extension member extends outwardly from the housing along the extension axis and the cartridge support extends outwardly from the extension member along the extension axis to enable the cartridge to be mounted to the cartridge support, and (b) a retracted position, wherein the extension member and the cartridge support are moved inwardly into the cartridge receiving space so that, when the cartridge is mounted to the cartridge support, the cartridge is moved into an operative position in the cartridge receiving space.

A further aspect of embodiments of the present invention provides a transfer device that includes a housing that defines a cartridge receiving space, a cartridge, an extension member that is slidably connected to the housing for rectilinear movement relative to the housing along an extension axis, and a cartridge support that is slidably connected to the extension member for rectilinear movement relative to the extension member along the extension axis. The cartridge support is constructed to mount the cartridge thereon. The cartridge includes a body with a longitudinal axis, a supply roll that is rotatably mounted to the body on the longitudinal axis, and a take-up roll that is rotatably mounted to the body on the longitudinal axis in spaced relation to the supply roll. The supply roll includes a wound length of liner that has an adhesive carrying surface with an adhesive provided thereon, and the take-up roll has at least an end portion of the liner connected thereto, such that rotation of the take-up roll in a take-up direction winds portions of the liner unwound from the supply roll onto the take-up roll. The cartridge support, the extension member, and the housing are constructed and arranged to enable the cartridge support and the extension member to be moved between (a) an extended position wherein the extension member extends outwardly from the housing along the extension axis and the cartridge support extends outwardly from the extension member along the extension axis to enable the cartridge to be mounted to the cartridge support, and (b) a retracted position, wherein the extension member and the cartridge support are moved inwardly into the cartridge receiving space so that, when the cartridge is mounted to the cartridge support, the cartridge is moved into an operative position in the cartridge receiving space.

Another aspect of embodiments of the present invention is to provide a method for loading a cartridge into a transfer device. The cartridge includes a body with a longitudinal axis, a supply roll that is rotatably mounted to the body on the longitudinal axis, and a take-up roll that is rotatably mounted to the body on the longitudinal axis in spaced relation to the supply roll. The supply roll includes a wound length of liner that has an adhesive carrying surface with an adhesive provided thereon. The take-up roll has at least an end portion of the liner connected thereto such that rotation of the take-up roll in a take-up direction winds portions of the liner unwound from the supply roll onto the take-up roll. The transfer device includes a housing that defines a cartridge receiving space, an extension member that is slidably connected to the housing for rectilinear movement relative to the housing along an extension axis, and a cartridge support that is slidably connected to the extension member for rectilinear movement relative to the extension member along the extension axis. The cartridge support is constructed to mount the cartridge thereon. The cartridge support, the extension member, and the housing are constructed and arranged to enable the cartridge support and the extension member to be moved between (a) an extended position wherein the extension member extends outwardly from the housing along the extension axis and the cartridge support extends outwardly from the extension member along the extension axis to enable the cartridge to be mounted to the cartridge support, and (b) a retracted position, wherein the extension member and the cartridge support are moved inwardly into the cartridge receiving space so that, when the cartridge is mounted to the cartridge support, the cartridge is moved into an operative position in the cartridge receiving space. The method includes sliding the cartridge support and the extension member outwardly of the housing to the extended position, mounting the cartridge to the cartridge support in the extended position, and sliding the cartridge support and the extension member inwardly into the cartridge receiving space of the housing to the retracted position to move the cartridge into the operative position in the cartridge receiving space.

A further aspect of embodiments of the present invention is to provide a cartridge for mounting to different types of a transfer devices. The cartridge includes a supply roll that has a supply of liner wound thereon. The liner is provided with an adhesive thereon. The cartridge also includes a take-up roll that has at least an end of the liner connected thereto such that rotation of the take-up roll winds the liner thereon, and a cartridge body connecting the supply roll and the take-up roll. The cartridge further includes an applicator head that has (a) a definite length transfer surface that is configured to engage the liner opposite the adhesive and apply a definite length of adhesive from the liner to a target substrate and (b) an indefinite length transfer surface that is configured to engage the liner opposite the adhesive and apply an indefinite length of adhesive from the liner to a target substrate. The applicator head is movable to a definite length transfer position having the liner trained over the definite length transfer surface and enabling the cartridge to be removably mounted in an operative position to a definite length adhesive transfer device for transferring adhesive to the target substrate. The definite length adhesive transfer device includes a frame that is configured to receive the cartridge, and an advancer constructed to affect rotation of the take-up and supply rolls to advance the liner so as to position a definite length portion thereof adjacent the definite length transfer surface, thus enabling the definite length transfer surface to press the definite length portion of the liner against the target substrate and transfer the definite length of adhesive thereto. The applicator head is also movable to an indefinite length transfer position having the liner trained over the indefinite length transfer surface and enabling the cartridge to be removably mounted in an operative position to an indefinite length adhesive transfer device for transferring adhesive to the target substrate. The indefinite length adhesive transfer device includes a frame that is configured to receive the cartridge so that the indefinite length transfer surface can engage the liner against the target substrate and transfer an indefinite length of adhesive thereto by moving the indefinite length transfer device along the target substrate to apply a length of adhesive as desired.

Other objects, features, and advantages of the present invention will become apparent from the following detailed description, the accompanying drawings, and the appended claims.

BRIEF DESCRIPTION OF THE DRAWINGS

Features of the invention are shown in the drawings, which form part of this original disclosure, in which like parts are represented by like reference numerals, and in which.

DETAILED DESCRIPTION OF THE ILLUSTRATED EMBODIMENTS

Figure 1:
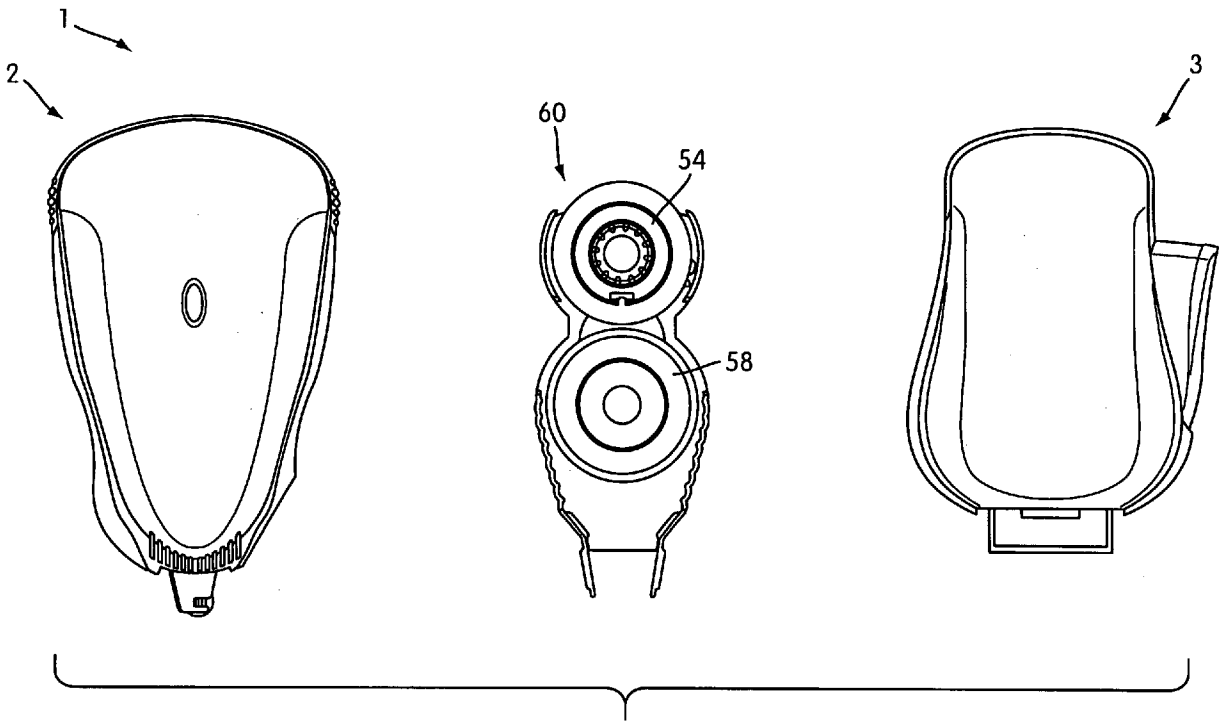
FIG. 1 is a front view of a transfer device system of one embodiment of the present invention, the system including an indefinite length transfer device on the left, a cartridge in the middle, and a definite length transfer device on the right.

FIG. 1 illustrates a system 1 for applying an adhesive to a target substrate. The system 1 includes a first transfer device 2, a second transfer device 3, and a cartridge 60. The first transfer device 1 may be a definite length transfer device or an indefinite transfer device and the second transfer device 3 would be the other. For purposes of this description, the first transfer device 1 is an indefinite length transfer device 10, illustrated in FIGS. 2 and 4–7, and the second transfer device 3 is a definite transfer device 30, 330 illustrated in FIGS. 2, and 8–19.

Figure 8:
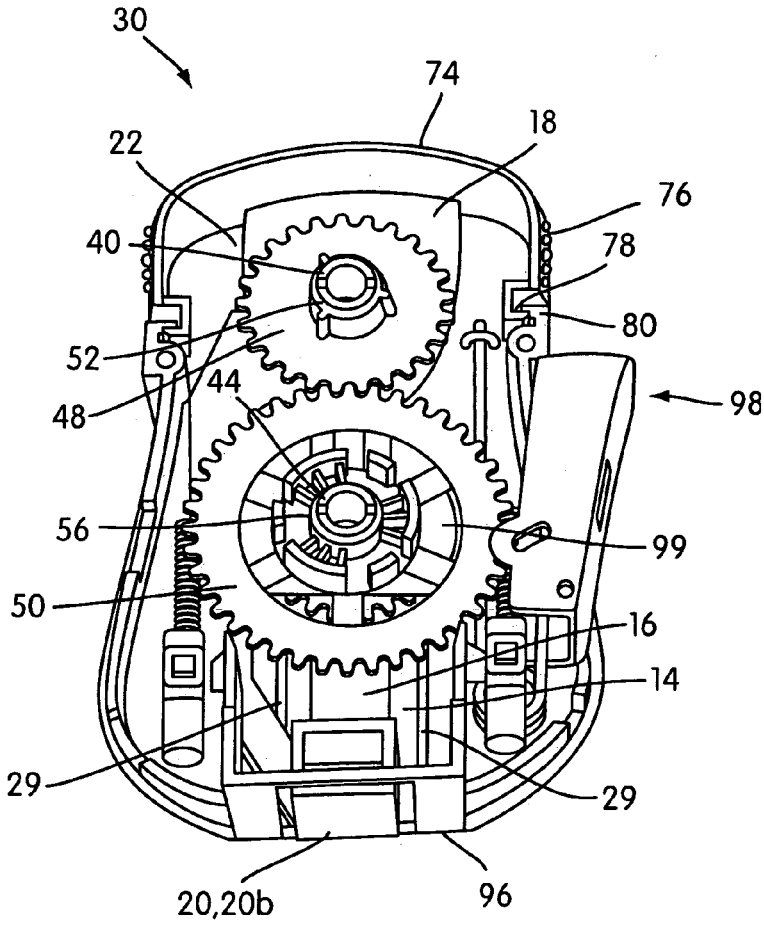
FIG. 8 is a bottom perspective view of the definite transfer device of FIG. 3, without a cartridge, with a portion of the housing removed, and with a locator in an upward position.
Figure 9:
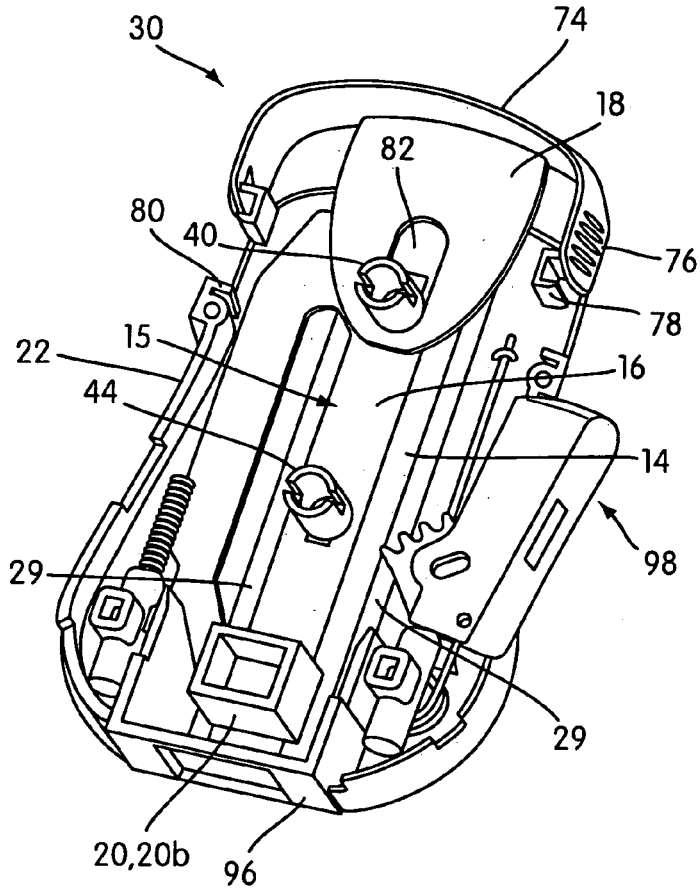
FIG. 9 is a side perspective view of the definite transfer device of FIG. 8, with a plurality of gears removed.

The common features of the different types of transfer devices will now be described. For simplicity, the common features described below and the corresponding figures will be directed to the indefinite length transfer device 10, as illustrated in FIGS. 4–7. It is understood that these common features will also be present in at least one embodiment of the definite length device 30 and such common reference numerals will be used. FIGS. 8 and 9 show some of these features in the definite length transfer device 30.

As shown in FIGS. 4–7, the indefinite length transfer device 10 includes a housing 12, an extension member 14, a cartridge support 15, and a head 20 on the cartridge support 15. The cartridge support 15 includes a cartridge support portion 16 and a head support portion 18.

The housing 12 includes a first main housing wall 22 and a second main housing wall 24 that are substantially flat and substantially parallel to one another. The two main housing walls 22, 24 are greater in length and width than any other wall of the housing. The main housing walls 22, 24 are spaced apart so that the internal parts of the indefinite transfer device 10, described below, can be contained within the device 10, yet still provide for a compact design. The main housing walls 22, 24 may be connected by separate wall pieces disposed substantially perpendicular to the main housing walls 22, 24. Preferably, the main housing walls 22, 24 each include substantially perpendicular portions 23 that are integrally formed as part of the main housing wall 22, 24. The perpendicular portions 23 can be designed to mate with one another such that when the housing 12 is assembled, the perpendicular portions 23 interconnect to form a side wall that spaces the main housing walls 22, 24 apart. The housing 12, however, may have any construction or configuration, and the invention is not intended to be limited to the one illustrated.

Figure 7:
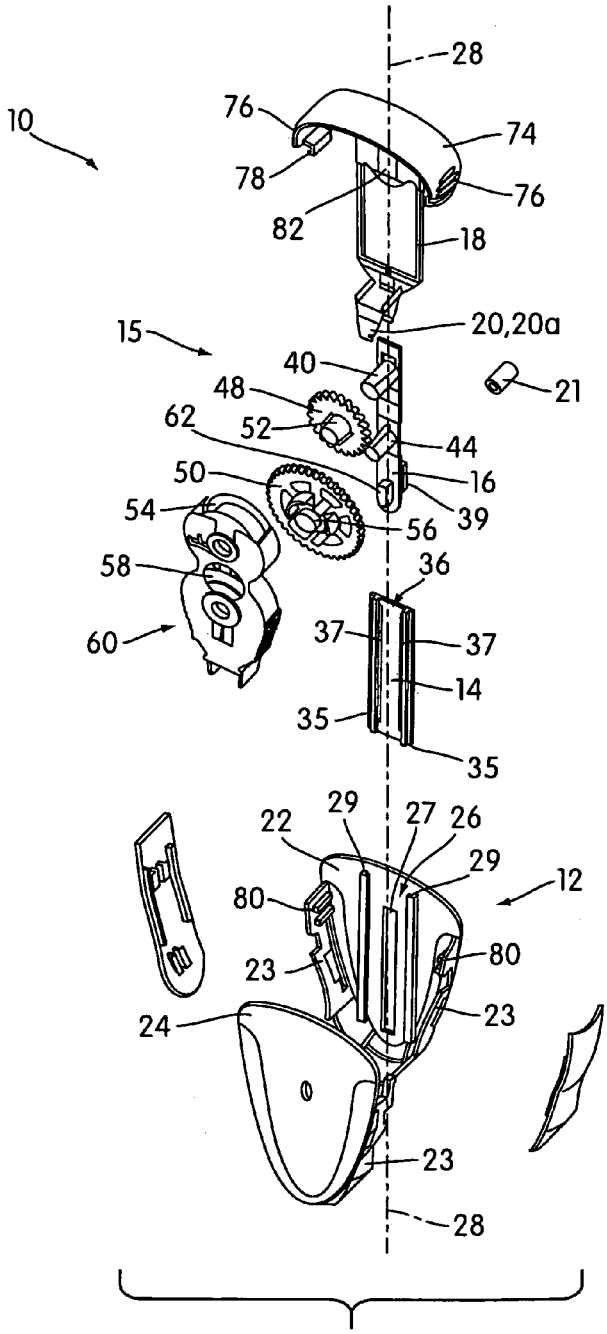
FIG. 7 is an exploded view of the indefinite transfer device of FIG. 2, along with the cartridge of FIG. 1.

As shown in FIG. 7, the first main housing wall 22 further includes a housing track 26. The housing track 26 is disposed on an extension axis 28 of the indefinite transfer device 10. Preferably, the housing track 26 includes a groove 27 that is disposed along the extension axis 28 and two L-shaped channels 29 that are disposed on opposite sides of the groove 27.

The extension member 14 is slidably connected to the housing 12 for rectilinear movement relative to the housing 12 along the extension axis by way of the housing track 26. The extension member 14 can slide along the first main housing wall 22 within the housing track 26. This allows for the inner workings of the indefinite transfer device 10, described below, to be pulled out of the indefinite transfer device 10 a certain distance without having to disassemble the housing 12. The extension member 14 includes a tongue (not shown) disposed at the lower end of the extension member 14. The tongue fits into the groove 27 of the housing track 26 and acts as both a guide and a stop. The extension member 14 also includes a pair of notches 35 that slidably engage with the L-shaped channels 29 of the housing track 26 to guide the extension member 14 along the housing track 26. The extension member 14 further includes an extension track 36. In the illustrated embodiment, the extension track 36 includes a pair of slots 37 facing inwardly towards one another. The slots 37 are disposed on opposite sides of the extension axis 28 and extend a substantial length along the extension member 14. The extension member 14, however, may have any construction, or configuration, and the invention is not intended to be limited to the one illustrated.

Figure 6:
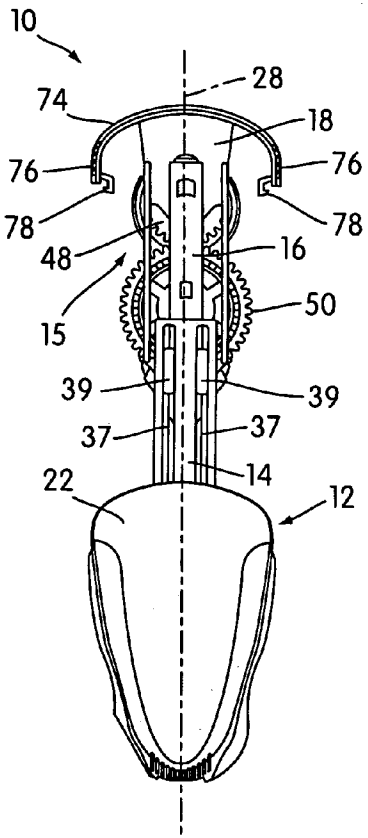
FIG. 6 is a rear view of the indefinite transfer device of FIG. 2, in the open position.
Figure 5:
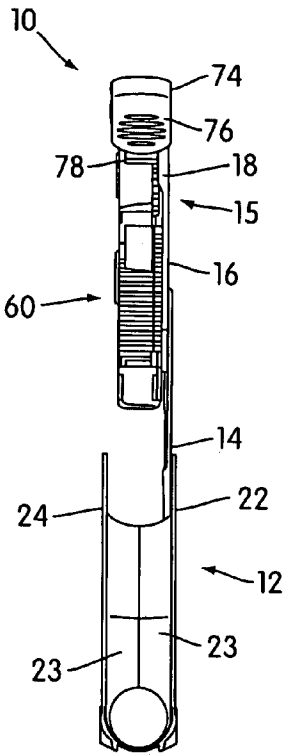
FIG. 5 is a side view of the indefinite transfer device of FIG. 2, in the open position.

The cartridge support portion 16 is slidably connected to the extension member 14 for rectilinear movement relative to the extension member 14 along the extension axis 28 by way of the extension track 36. Two tongues 39, shown in FIG. 6, are disposed on the cartridge support portion 16 on opposite sides of the extension axis 28 such that they fit into the slots 37 of the extension track 36. At least one gear post 40 is disposed on the cartridge support portion 16. Preferably, two gear posts, a first gear post 40 and a second gear post 44, are disposed on one side of the cartridge support portion 16 along the extension axis 28. The first gear post 40 is disposed towards an outer end of the cartridge support portion 16. The gear posts 40, 44 are spaced such that two gears 48, 50 can be rotatably mounted to the posts 40, 44 and intermeshed with one another. A tongue 62 is disposed on the same side of the cartridge support portion 16 as the gear posts 40, 44, at an inner end, along the extension axis 28 to create a track for the head support portion 18. The cartridge support portion 16, however, may have any construction or configuration, and the invention is not intended to be limited to the one illustrated.

A take-up gear 48 includes a hub 52 with an inner surface and an outer surface. The inner surface of the take-up gear hub 52 is rotatably mounted to the first gear post 40. Likewise, a supply gear 50 includes a hub 56 with an inner surface and an outer surface. The inner surface of the supply gear hub 56 is rotatably mounted to the second gear post 44. The gear posts 40, 44 and gears 48, 50 are sized such that the teeth of both gears 48, 50 are intermeshed. This allows the rotation of one gear to drive the rotation of the other gear, and vice-versa. The outer surface of the take-up gear hub 52 is designed to receive a take-up roll 54. Likewise, the outer surface of the supply gear hub 56 is designed to receive a supply roll 58. The gears 40, 44, however, may have any construction or configuration, and the invention is not intended to be limited to the one illustrated.

The head support portion 18 includes a lower end and an upper end. One side of the head support portion 18 contacts the cartridge support portion 16. At the upper end of the head support portion 18, an end cap portion 74 is disposed such that it is substantially perpendicular to the extension axis 28. When the indefinite transfer device 10 is fully assembled, the end cap portion 74 forms a side wall to the housing 12. The end cap portion 74 includes a pair of flexible ends 76 that include hooks 78 that engage with detents 80 located in the housing 12 when the head support portion 18 is fully inserted into the indefinite transfer device 10. A slot 82 is disposed towards the upper end of the head support portion 18. The slot 82 is sized such that the first gear post 40 can be inserted into the slot 82 for a loose fit. The head support portion 18 is placed in contact with the cartridge support portion 16 and held in place by the take-up gear 48, once the take-up gear 48 is rotatably mounted to the first gear post 40. The head support portion 18 includes a groove along the extension axis 28, towards the lower end of the head support portion 18. The groove engages the tongue 62 disposed on the cartridge support portion 16 when the cartridge support portion 16 and the head support portion 18 are aligned. The head 20 is disposed on the head support portion 18, at the lower end. The head support portion 18, however, may have any construction or configuration, and the invention is not intended to be limited to the one illustrated.

Figure 2:
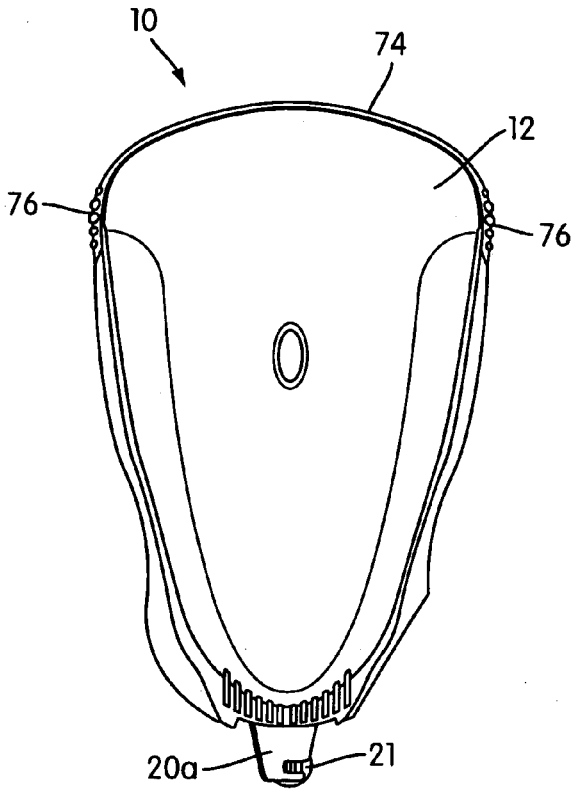
FIG. 2 is a front view of the indefinite transfer device of FIG. 1, in the closed position.

The specific design, e.g. shape, of the head 20 is dependent on the type of transfer device 10, 30 on which it is disposed. FIG. 2 illustrates an exemplary head 20*a* of the indefinite length transfer device 10 and FIGS. 8 and 9 illustrate an exemplary head 20*b* of the definite length transfer device 30.

Figure 4:
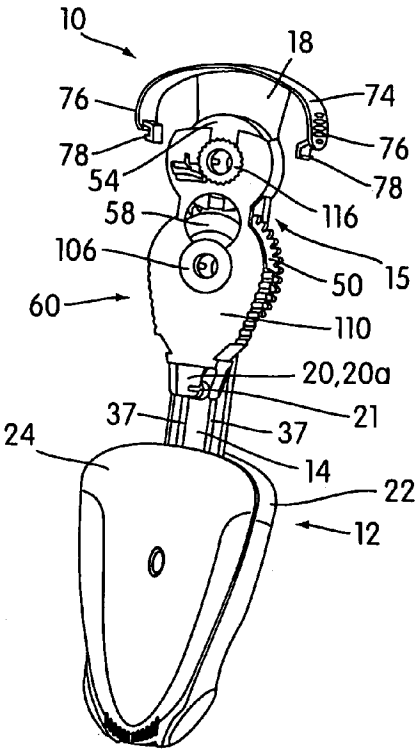
FIG. 4 is a perspective view of the indefinite transfer device of FIG. 2, in the open position.

The head 20*a* of the indefinite length transfer device 10 may be substantially triangular such that an apex is located on the extension axis 28 of the indefinite transfer device 10 and points outward from the device 10. This creates an indefinite length transfer surface at an angle relative to the extension axis 28 of the device 30. This design encourages the user to place the indefinite transfer device 10 at an angle to apply the adhesive. One embodiment of the head 20*a*, as illustrated in FIGS. 2, 4 and 7, includes a truncated triangle with a roller 21. The roller 21 is rotatably mounted on the head 20*a* and creates a smaller surface so that increased pressure can be used to assist in applying the adhesive to the desired location on the substrate. The roller 21 may include a soft material that allows for better conformity to the target substrate. This allows for a more uniform application. The roller also preferably includes a non-stick surface, such as silicone, so that the adhesive will not stick to the roller. The head 20*a*, however, may have any construction or configuration, and the invention is not intended to be limited to the one illustrated.

The head 20*b* of the definite length transfer device 30, as illustrated in FIGS. 8 and 9, is substantially rectangular such that an outward surface of the head creates a definite length transfer surface that is substantially perpendicular to the extension axis 28 of the device 30. Thus, the size of the "stamped" adhesive can be no larger than the outward surface of the head. The head 20*b*, however, may have any construction or configuration, and the invention is not intended to be limited to the one illustrated.

Figure 3:
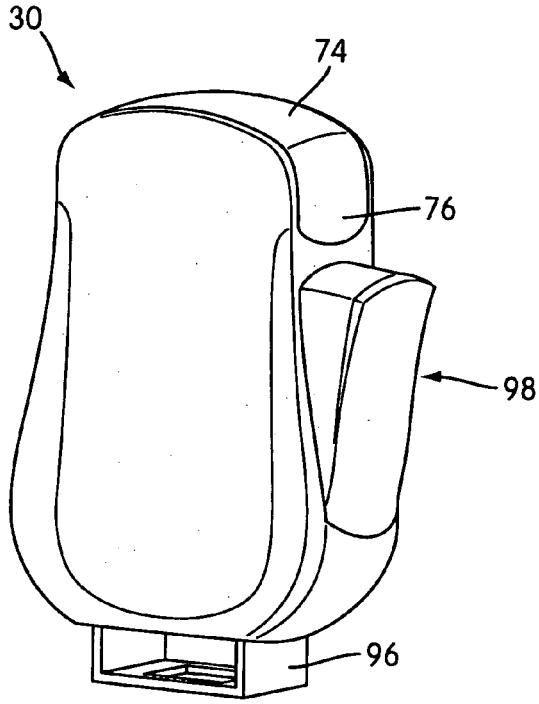
FIG. 3 is a side perspective view of the definite transfer device of FIG. 1, in the closed position.

As shown in FIGS. 3, 8, and 9, the definite length transfer device 30 also includes a locator 96 that allows the user to place the transfer device 30, and hence the adhesive, at the desired location and apply the correct amount of force to ensure the adhesive is properly disposed onto the target substrate. The locator 96 can be a spring loaded locator that returns to its normal position, as illustrated in FIG. 3, when no force is applied to the transfer device 30. The locator 96, however, may have any construction or configuration, and the invention is not intended to be limited to the one illustrated.

The definite transfer device 30 may also include an advancement system, including an advancer 98 and an advancement gear 99, that is constructed to affect rotation of the take-up and supply rolls 54, 58 upon actuation of the advancer 98. This advances a liner, containing the adhesive, so as to position a definite length portion thereof adjacent the definite length transfer surface. In the illustrated embodiment, as shown in FIGS. 8 and 9, the advancer 98 includes a plurality of teeth that intermesh with teeth disposed on the advancement gear 99. The advancement gear 99 is rotatably mounted on the same gear post 44 on which the supply gear 50 is rotatably mounted, in between the supply gear 50 and the cartridge support portion 16. The advancement gear 99 contacts the supply gear 50 such when the advancement gear 99 rotates in one direction, the supply gear 50 will also rotate, but when the advancement gear 99 rotates in the opposite direction, the supply gear will not rotate (i.e., it acts as a one-way clutch).

When the advancer 98 is depressed, the advancement gear 99 rotates, causing the supply gear 50 to rotate to advance the liner. When the advancer 98 is released, the advancement gear 99 returns to its initial position, but the supply gear 50 does not rotate. This description of the advancement system should not be construed in any way as limiting. It is understood that a more automated advancement system could be used, wherein the user would not have to manually advance the liner, as described above. For instance, the advancement gear 99 could be linked to the locator 96, such that the release of the locator 96 would cause the advancement gear 99, and, hence, the supply gear 50 to rotate. Thus, the advancement system, including the advancer 98 and advancement gear 99 may have any construction or configuration, and the invention is not intended to be limited to the one illustrated.

Figure 10:
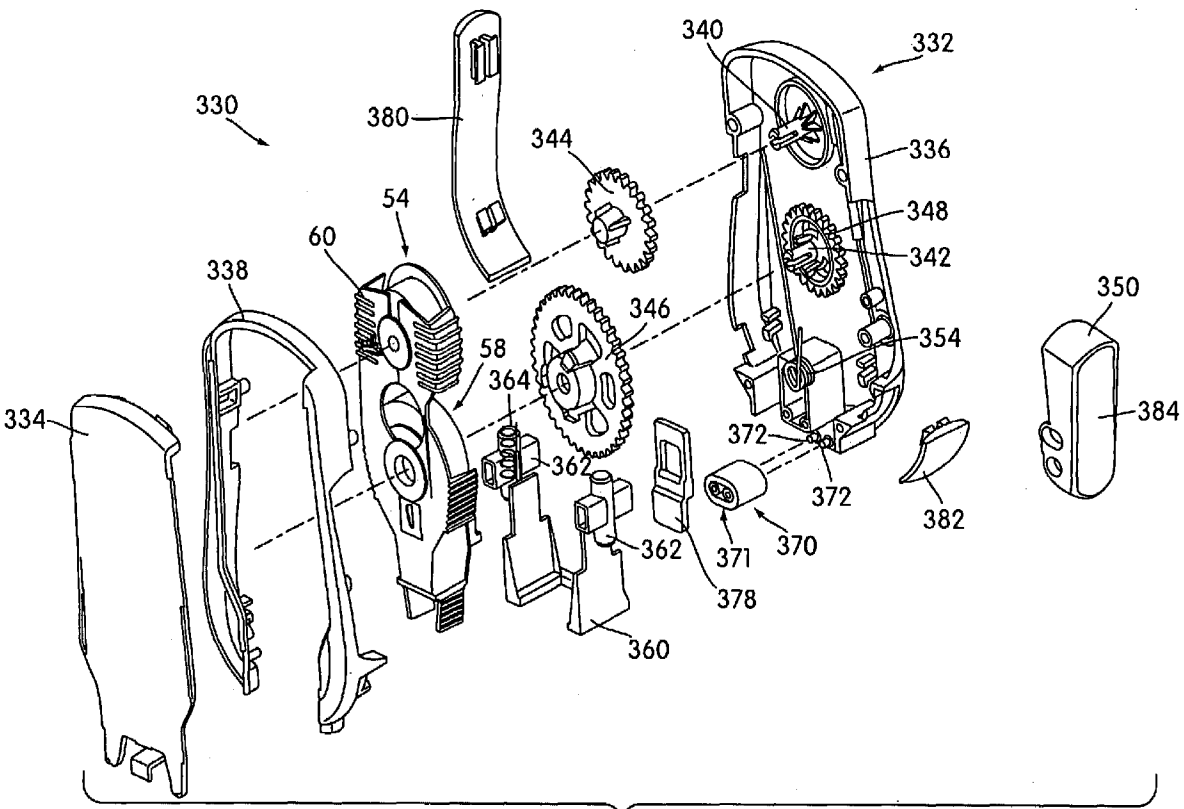
FIG. 10 is an exploded view of another embodiment of a definite length transfer device, with a cartridge.
Figure 17:
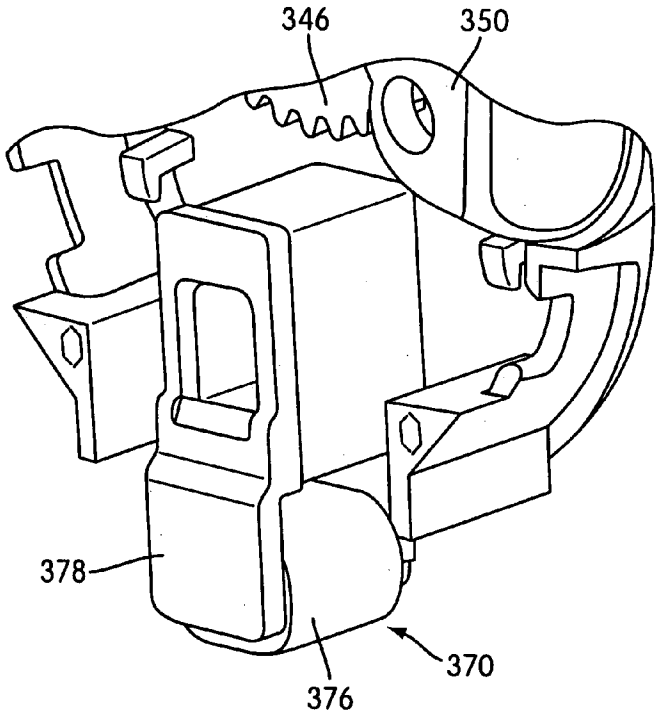
FIG. 17 is an enlarged view of a portion of FIG. 16.
Figure 18:
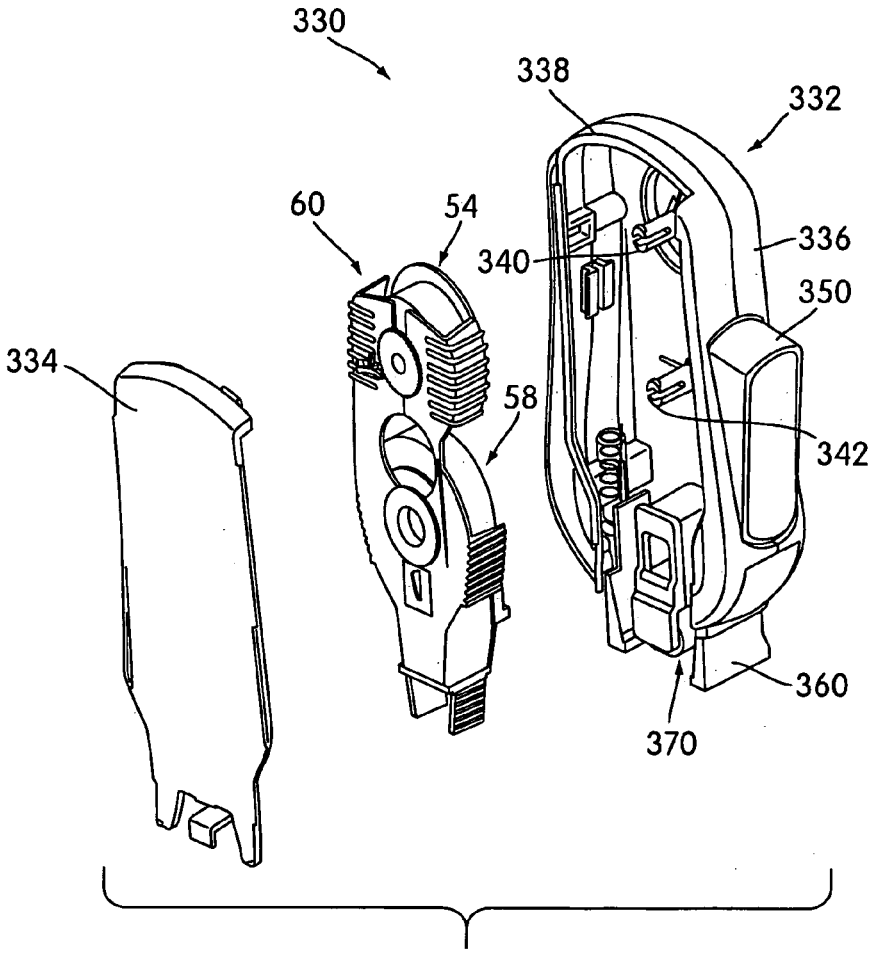
FIG. 18 is a view of the definite length transfer device of FIG. 10 with a cartridge and a cover removed.
Figure 19:
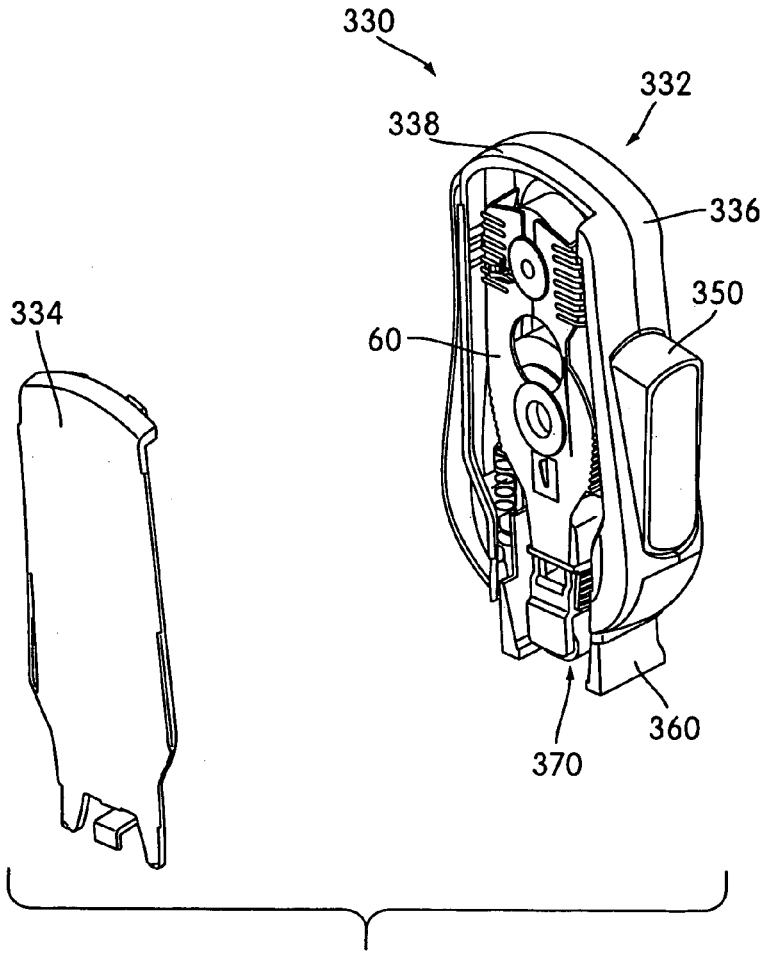
FIG. 19 is a side perspective view of the definite length transfer device and cartridge of FIG. 18, with the cartridge mounted to the transfer device and the cover removed.

A second embodiment of the definite length transfer device 330 is illustrated in FIGS. 10–19. As shown in FIGS. 10, 18, and 19, the definite length transfer device 330 includes a main housing body 332 and a removable cover 334. The removable cover 334 may be secured to the main housing body 332 once the cartridge 60 is mounted to the definite length transfer device 330. Although it is not illustrated in the figures, it is understood that a removable cover similar to the removable cover 334 illustrated in connection with the definite length transfer device 330 may also be provided for the indefinite length transfer device 10 that is illustrated in FIGS. 2 and 4–7.

The main housing body 332 includes a back portion 336 and a front portion 338. The front portion 338 is designed to press-fit onto the back portion 336 during assembly of the device 330 so as to form one unit. A first gear post 340 and a second gear post 342 are attached to the back portion 336 of the main housing body 332 in a spaced relation, as shown in FIG. 10. The first gear post 340 is configured to receive a first gear 344 and the second gear post 342 is configured to receive a second gear 346 and a third gear 348. In the illustrated embodiment, the first gear 344 is configured to receive the take-up roll 54 that is disposed on the cartridge 60 and the second gear 346 is configured to receive the supply roll 58 that is disposed on the cartridge 60. As discussed further below, the supply roll 58 includes a wound supply of liner. The liner includes an adhesive that is disposed on one side of the liner. As illustrated, the third gear 348 is located on a side of the second gear 346 that is opposite the supply roll 58 when the cartridge 60 is mounted to the definite length transfer device 330.

Figure 11:
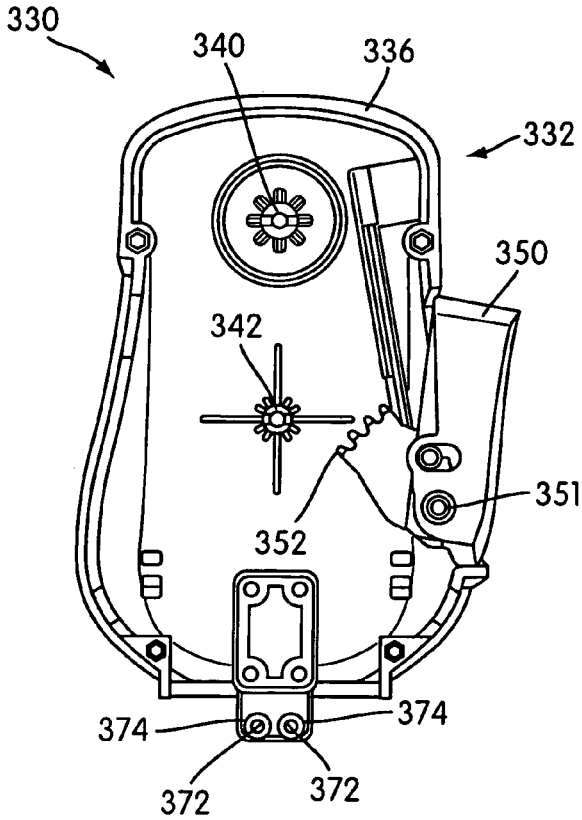
FIG. 11 is a front view of the definite length transfer device of FIG. 10 with certain parts removed.
Figure 12:
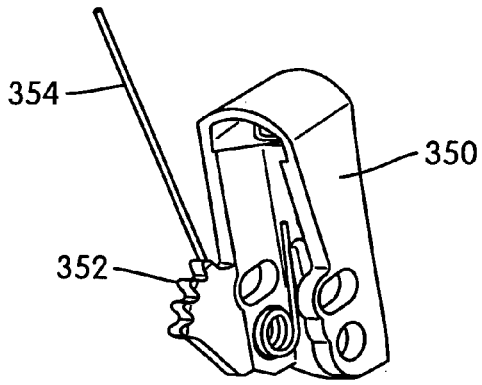
FIG. 12 is a side perspective view of an advancer of the definite length transfer device of FIG. 11.
Figure 13:
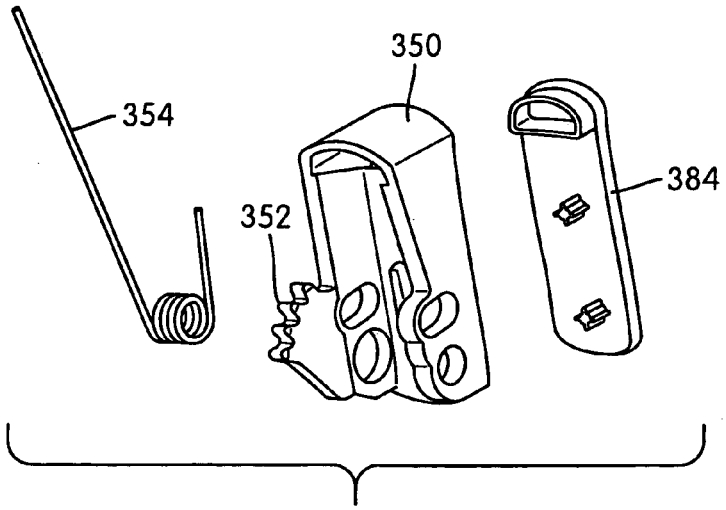
FIG. 13 is an exploded view of FIG. 12.

The third gear 348 is operatively connected to an advancer 350. As shown in FIG. 11, the advancer 350 is disposed on one side of the main housing 332 and extends outward from the main housing 332. As illustrated, the advancer 350 is connected to the back portion 336 of the main housing 332 at a pivot point 351. This way, as an outward end of the advancer 350 is depressed by the user, the advancer 350 will rotate inward about the pivot point 351. A plurality of teeth 352 are disposed at an inner side of the advancer 350 such that they engage the third gear 348 when the third gear 348 is disposed on the second gear post 342. As illustrated in FIGS. 11–13, a biasing member 354 is also provided to bias the advancer 350 in the outward position such that when the user presses the advancer 350, and then releases the advancer 350, the advancer 350 will return to the outward position. FIG. 13 also shows an optional molding piece 384 that may be attached to the advancer 350. The molding piece 384 is preferably molded from a material that is softer than the material used to make the advancer 350, thereby providing the user with additional comfort and grip.

Figure 16:
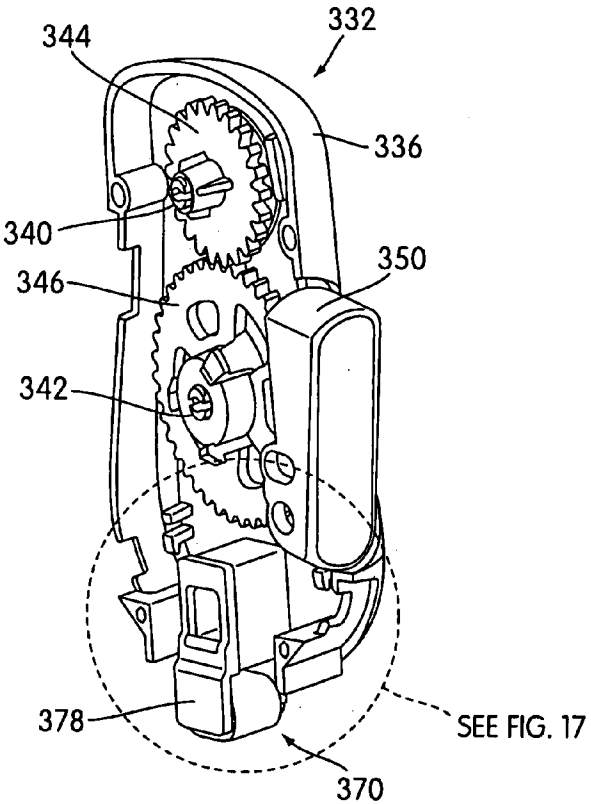
FIG. 16 is a side perspective view of the definite length transfer device of FIG. 10 with certain parts removed.

As shown in FIG. 16, the first gear 344 and the second gear 346 are rotatably disposed on the first gear post 340 and the second gear post 342, respectively, such that teeth disposed on each of the respective gears 344, 346 mesh. In operation, rotation of the second gear 346 causes rotation of the first gear 344, and vice-versa. The second gear 346 is connected to the third gear 348 such that both the second gear 346 and the third gear 348 rotate together, thereby allowing the advancer 350 to affect rotation of the second gear 346. However, the second gear 346 and the third gear 348 are designed to allow slippage between the two gears 346, 348 if an excess amount of force is exerted on, for example, the second gear 346, as will be further explained below. Because the second gear 346 is meshed with the first gear 344, the advancer 350 also affects rotation of the first gear 344. The gear ratios of the three gears 344, 346, 348 are such that when the advancer 350 is fully depressed by the user, the liner that is disposed on the supply roll 58 will be advanced so as to expose a new length of adhesive at the transfer surface 371, and the liner that has traveled past the transfer surface 371 will be wound onto the take-up roll 54.

Returning to FIG. 10, a locator 360 is also provided. The locator 360 is connected to the main housing portion 332 at one end, adjacent an application head 370 (discussed below) so as to provide a locating surface for the device 330. The locator 360 is disposed between the back portion 336 and the front portion 338 of the main housing portion 332. A pair of mounting posts 362 are provided on each side of the locator 360. The pair of mounting posts 362 are attached to both the back portion 336 and the front portion 338 of the main housing body 332. A pair of springs 364 (only one shown) are disposed in the pair of mounting posts 362 (one spring in each post). The pair of springs 364 bias the locator 360 in an inoperative position outward from the main housing body 332. When the definite length transfer device 330 is depressed against the target substrate, the locator 360 moves upward and into the main housing body 332 so that the transfer surface 371 may come into contact with the target substrate. When the definite length transfer device 330 is released from the target substrate, the locator 360 extends outward from the main housing body 332, thereby protecting the transfer surface 371.

Figure 14:
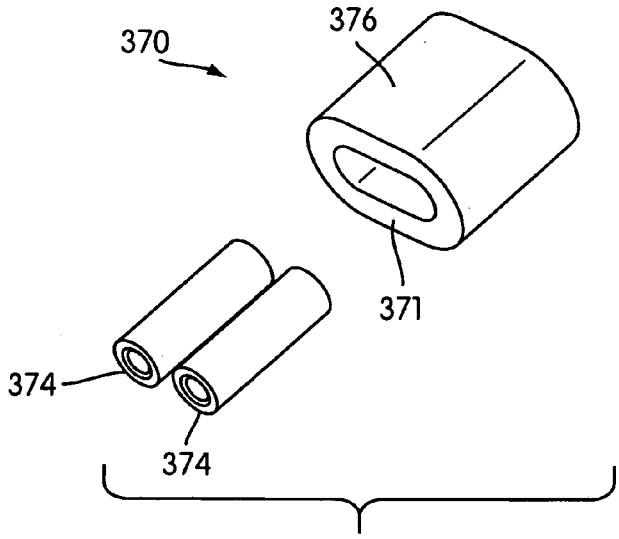
FIG. 14 is an exploded view of an applicator head of the definite length transfer device of FIG. 10.
Figure 15:
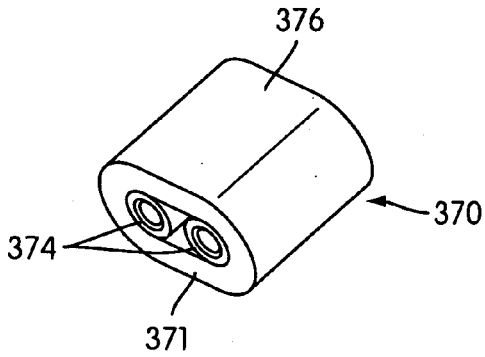
FIG. 15 is a view of the head of FIG. 14 assembled.

As shown in FIGS. 10 and 11, a plurality of posts 372 are disposed at a lower end of the back portion 336 of the main housing body 332 and are configured to support an application head 370. The posts 372 define substantially parallel axes that are spaced apart from one another. The distance between the posts 372 defines the length of the transfer surface 371. The head 370 includes a plurality of rollers 374 that are rotatable about the plurality of posts 372. The rollers 374 may have any shape and configuration. In the illustrated embodiment, the rollers 374 are substantially the same size and configuration. A closed-loop belt 376, as shown in greater detail in FIGS. 14 and 15, is trained about the rollers 374 to provide the transfer surface 371. The transfer surface 371 faces outwardly of the device 330 and the rotation of the rollers 374 enable the belt 376 to travel around the rollers 374. A portion of the liner between the supply roll 58 and take-up roll 54 is trained over the head 370 such that the transfer surface 371 of the belt 376 engages a backside surface of the liner opposite an adhesive carrying surface of the liner.

The belt 376 is preferably a soft silicone, or silicone-like material that resists adhesive materials and is able to conform to uneven surfaces. This way, as the belt 376 comes into contact with the target substrate, a maximum area of the transfer surface 371 will come into contact with the target substrate. The liner typically has a release surface that is also made from a silicone-like material. It has been found that when two silicone-like materials contact one another, the materials have a tendency to stick to one another. Because the belt 376 is rotatable about the rollers 374, movement of the liner will cause the belt 376 to move, which will cause the rollers 374 to rotate, thereby easing the tension on the liner. That is, allowing the belt 376 to move prevents the liner from sticking to the head 370, which causes tension to build-up in the liner (a problem which increases as the radius of the take-up roll 54 increases and in turn cause the liner advancement rate to increase for each stroke of the advancer 350). Thus, the surface of the belt 376 preferably comprises material that is substantially the same as material comprised in the liner, both materials preferably being of the type having a low affinity for adhesive bonding.

The head 370 is provided on the device 330 to enable the adhesive to be transferred to a target substrate by engaging the adhesive carrying surface on the portion of the liner trained over the belt with the target substrate and applying pressure to bond the adhesive to the target substrate. As the take-up roll 54 rotates in the take-up direction, the belt 376 rotates around the rollers 374, thereby assisting with the advancement of the liner so as to allow the liner with a new length of adhesive to be disposed along the transfer surface 371 in an outward position.

FIGS. 16 and 17 show the head 370 as it is attached to the back portion 336 of the main housing body 332. As illustrated, a clip 378 is also provided to assist in holding the head 370 in place. The clip 378 may include protrusions (not shown) that may be inserted into the rollers 374 so as to provide additional stability. The clip 378 may be removed so that the belt 376 may be replaced, if needed.

It should be understood that while the figures illustrate the head 370 as being part of a definite length transfer device 330, the head 370 may also be mounted on an indefinite length transfer device. In such a case, the head 370 may be positioned such that the roller 374 and belt 376 provide a transfer surface 371 that is oriented in any direction relative to the longitudinal centerline of the device. The application head 370 may have any construction or configuration, and the invention is not intended to be limited to the one illustrated.

FIGS. 18 and 19 illustrate the mounting of the cartridge 60 into the main housing body 332. The take-up roll 54 of the cartridge 60 is placed on the first post 340 and the supply roll 58 of the cartridge 60 is placed on the second post 342, while the liner (not shown) is trained over the head 370. Once the cartridge is inserted into the main housing body 332, the cover 334 may be snap-fit onto the main housing body 332. While the figures show an embodiment with a cartridge, the use of a cartridge should not in any way be construed as limiting. It is understood that a take-up roll and a supply roll may be provided directly onto the first gear 344 and the second gear 346 and a cartridge is not needed for the definite length transfer device 330 to be fully operational.

Once the supply roll 58 and the take-up roll 54 are attached to their respective gears 346, 344, the liner is trained over the outward side of the head 370, and the cover 334 is attached to the main housing body 332, the definite length transfer device 330 is ready to be operated. In operation, the user places the center of the locator 360 over the target surface and places the locator 360 onto the area surrounding the target surface. The user presses the advancer 350 inward and releases the advancer 350 to ensure a portion of the liner with "fresh" adhesive is adjacent the transfer surface 371. The user then firmly presses down on the definite length transfer device 330 such that the locator 360 cannot move any further into the main housing body 332 and the belt 376 is firmly pressed against the target substrate. The user then lifts the definite length transfer device 330 away from the target substrate, thereby leaving the adhesive on the target substrate. It is understood that the advancer 350 may be depressed at any time and that the definite length transfer device 330 does not have to be in place on the target substrate when the advancer 350 is depressed.

Although the indefinite length transfer device 10 and the definite length transfer device 30, 330 function differently to achieve different results, a common cartridge, such as the cartridge 60, can be used as a part of this overall system shown in FIG. 1. One embodiment of the cartridge 60, further illustrated in FIGS. 20–23, includes the supply roll 58 having a supply of liner 100 wound thereon. The liner 100 is provided with an adhesive thereon. The adhesive may be an emulsion-based acrylic permanent adhesive for certain applications. The adhesive may be patterned or uniform. Also, the adhesive may be a double-sided adhesive tab.

Figure 22:
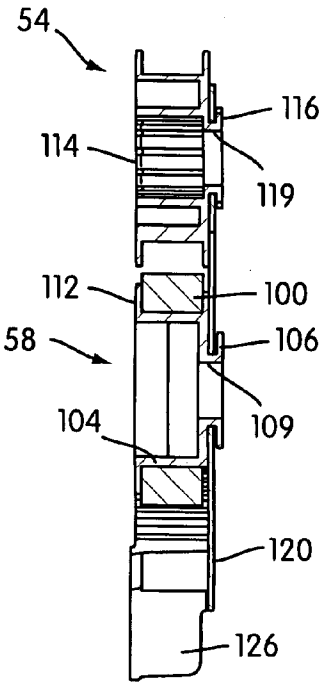
FIG. 22 is a cross-sectional view of section XXII—XXII of FIG. 21.
Figure 21:
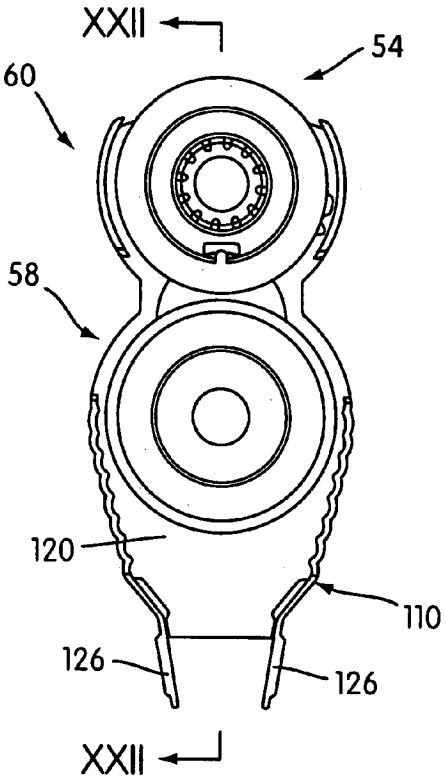
FIG. 21 is a front view of the cartridge of FIG. 20.
Figure 20:
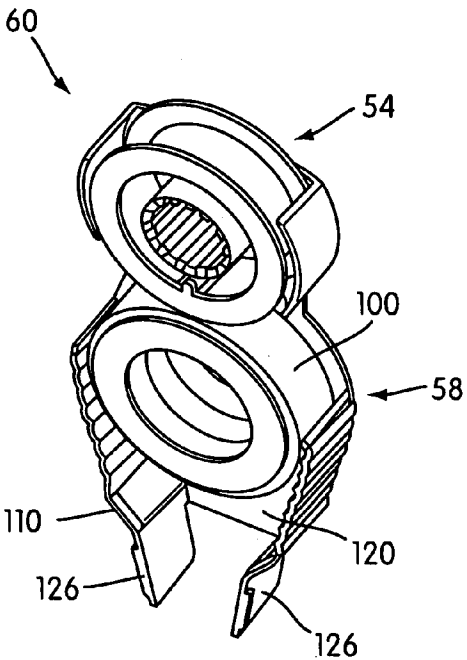
FIG. 20 is a side perspective view of one embodiment of a cartridge for the transfer devices.

As shown in FIG. 22, the supply roll 58 has a central hub 104 upon which the liner 100 is wound. One end of the hub 104 has a flange 106 slightly spaced apart therefrom to define a gap with a neck 109 therein that enables the hub 104 to be rotatably mounted to a cartridge body 110. The opposite end of the hub 104 has a larger flange 112 that protects an axial face of the supply roll 58. The interior of the hub 104 is generally cylindrical. However, the illustrated supply roll 58 should not be considered limiting and it may have any suitable construction or configuration.

The take-up roll 54 has at least an end of the liner 100 connected thereto such that rotation of the take-up roll 54 winds the liner 100 thereon. This connection may be established in any suitable manner that enables rotation of the take-up roll 54 to wind the liner 100 thereon. The take-up roll 54 has a hub 114 upon which the liner 100 winds and a flange 116 similar to the flange 106 on the hub 104 of the supply roll 58. The take-up roll flange 116 is spaced from the hub 114 and defines a gap with a neck 119 therein that enables the hub 114 to be rotatably mounted to the cartridge body 110. The take-up roll 54, however, may have any construction or configuration, and the invention is not intended to be limited to the one illustrated.

Figure 23:
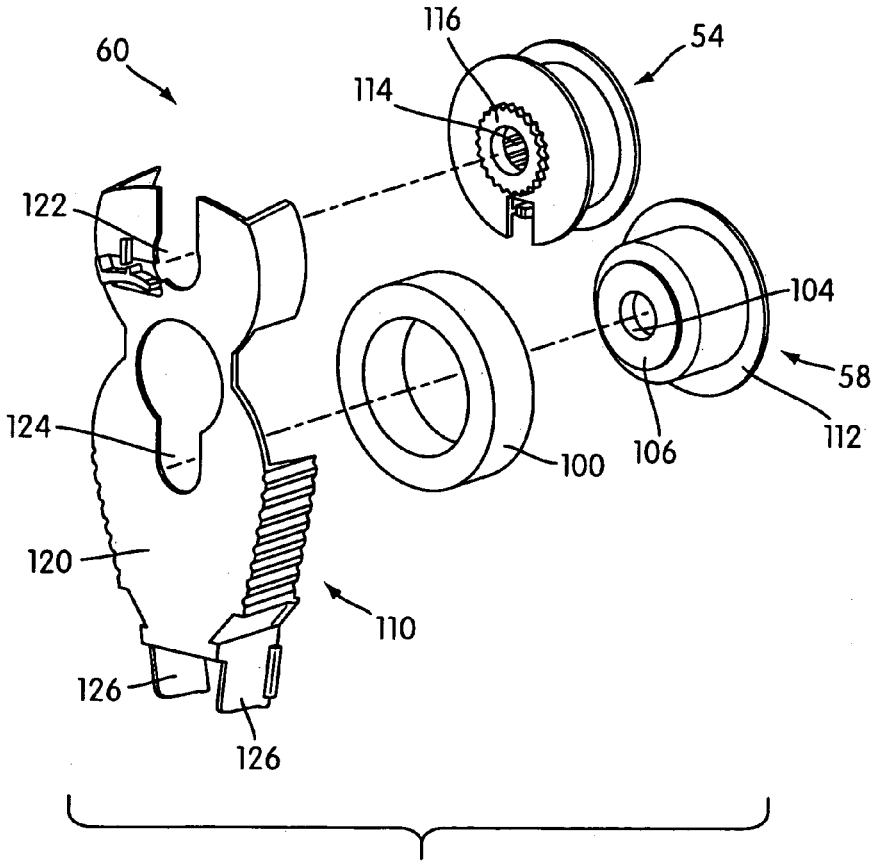
FIG. 23 is an exploded view of the cartridge of FIG. 20.

As shown in FIG. 23, the cartridge body 110 connects the supply roll 58 and take-up roll 54. Specifically, in the illustrated embodiment, the cartridge body 110 includes a plate-like member 120 formed of cardboard, plastic, or any suitable material. Two notches 122, 124 are formed in the plate-like member 120, one at a first end of the member and one in the middle of the member. The take-up roll 54 is rotatably mounted to the notch 122 located at the first end of the member and the supply roll 58 is rotatably mounted to the notch 124 located in the middle of the member. The take-up roll 54 rotatably mounts to the notch 122 by the neck 119 engaging within the notch 122 and the portion of the member 120 defining the notch 122 being received between the flange 116 and the hub 114. The supply roll 58 rotatably mounts to the notch 124 by the neck 109 engaging within the notch 124 and the portion of the member 120 defining the notch 124 being received between the flange 106 and the hub 104.

The cartridge body 110 further includes a pair of guides 126 that are disposed at the end of the plate-like member 120 opposite the first end. The guides 126 are substantially perpendicular to the plate-like member 120 and are spaced apart so as to fit the head 20 of either transfer device 10, 30 therebetween. The liner 100 is threaded around an outside surface of each of the guides 126, such that the liner 100 leaves the supply roll 58, goes around the pair of guides 126 and is wound onto the take-up roll 54.

The design of the cartridge 60 allows for the same cartridge to be used in either type of transfer device 10, 30, 330. This allows manufacturers and distributors to provide only one type of cartridge, which allows for lower costs. Also, it allows users to purchase just one cartridge for use in the different types of devices.

The mounting of the cartridge 60 into the different types of transfer devices 10, 30 will now be discussed. Starting with either transfer device 10, 30 in the fully closed position, the flexible ends 76 of the end cap portion 74 of the head support portion 18 are squeezed towards one another so as to disengage the hooks 78. The head support portion 18 can then be pulled outwards from the housing 12. The cartridge support 15 and the extension member 14 will also fully extend out of the housing 12 so that the gears 48, 50 and the head 20 are fully exposed. The order in which the head support portion 18, cartridge support portion 16, and extension member 14 fully extend will depend on the tolerances and friction between each of the three members 18, 16, 14, as well as between the extension member 14 and the housing track 26. For example, if the tolerance between the extension member 14 and the housing track 26 is less tight than the tolerance between the extension member 14 and the cartridge support portion 16, the extension member 14 will fully extend relative to the housing track 26 before the cartridge support portion 16 extends fully relative to the extension member 14. Once the extension member 14, the cartridge support portion 16, and the head support portion 18 are fully extended and the head 20 is fully exposed, the cartridge 60 can be loaded into the device 10, 30.

To load the cartridge 60, the plate-like member 120 is oriented away from the gears 48, 50. The hubs of the take-up roll 114 and supply roll 104 are then aligned with the hubs of the take-up gear 52 and supply gear 56, respectively, and pressed into place. The cartridge 60 is now mounted. Because the head support portion 18 is extended relative to the cartridge support portion 16, the head 20 is moved upwardly towards the gears 48, 50, and the part of the liner 100 held out by the guides 126 can easily pass over the head 20.

The head support portion 18, cartridge support portion 16 and extension member 14 can now be slid back into the housing 12. As the head support portion 18 slides relative to the cartridge support portion 16, the head 20 engages the liner 100 so that the transfer surface is formed. As discussed above, the order in which the extension member 14, cartridge support portion 16, and head support portion 18 enter the housing 12 depends on the tolerances and friction between the members 14, 16, 18, and between the extension member 14 and the housing 12. Once the extension member 14, the cartridge support portion 16, and the head support portion 18 are inside the housing 12, the flexible ends 76 of the end cap portion 74 are squeezed and the end cap portion 74 is pushed in towards the housing 12 so that the hooks 78 engage with the housing 12 at the detents 80. The flexible ends 76 can then be released so as to lock the head support portion 18, the cartridge support portion 16, and the extension member 14 into place. The indefinite transfer device 10, 30 is ready to use.

To unload the cartridge 60, same process to fully extend the extension member 14, the cartridge support portion 16, and the head support portion 18, discussed above, is used. Once the three members 14, 16, 18 are fully extended out of the housing 12, the liner 100 is no longer in contact with the head 20 and the cartridge 60 can be easily lifted off of the gears 48, 50. A new cartridge 60 can then be placed onto the gears 48, 50 as described above, or the trays 14, 16, 18 can be slid back into the housing 12 without a cartridge 60.

It is understood that a similar process, as described above, may be used to load and unload the embodiment of the cartridge 160 with the pivotable head 220. Unlike the process described above, at the time the cartridge 160 is mounted, the liner 200 is already engaged with the head 220.

As discussed above, mounting the cartridge 60 to the second embodiment of the definite length transfer device 330 first requires removing the cover 334 from the main housing body 332. The take-up roll 54 can then be attached to the first gear 344 while the supply roll 58 is attached to the second gear 346. The liner is passed on the outward side of the head 370 such that the transfer surface 371 is in contact with the liner. The cover 334 is then reattached to the main housing body 332. To remove the cartridge 60, the cover 334 is first removed from the main housing body 332, thereby exposing the cartridge 60. The cartridge 60 can then be removed.

Another embodiment of a cartridge 160 is illustrated in FIGS. 24–28. The cartridge 160 comprises a supply roll 158 having a supply of liner 200 wound thereon. The liner 200 is provided with an adhesive thereon, which adhesive may of any type, as described above.

Figure 26:
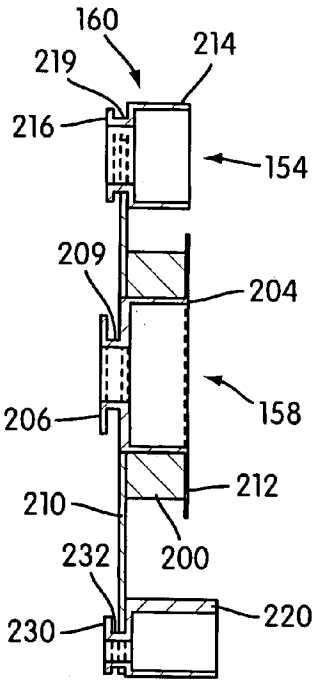
FIG. 26 is a cross-sectional view of section XXVI—XXVI of FIG. 25.
Figure 25:
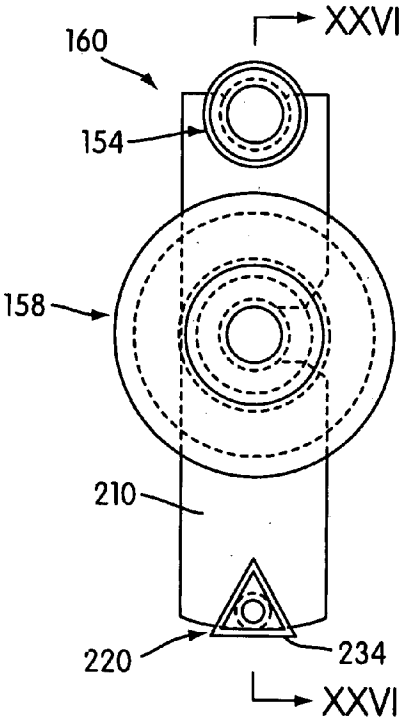
FIG. 25 is a front view of the cartridge of FIG. 24.
Figure 24:
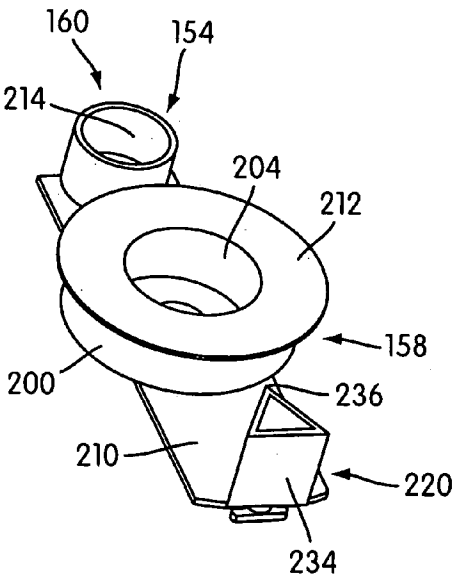
FIG. 24 is a bottom perspective view of another embodiment of a cartridge for the transfer devices.
Figure 28:
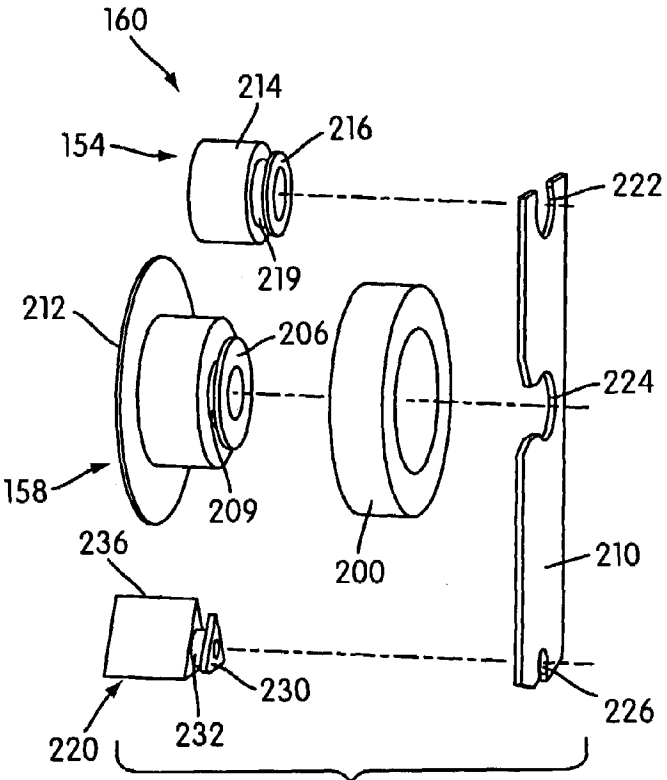
FIG. 28 is an exploded view of the cartridge of FIG. 27.
Figure 27:
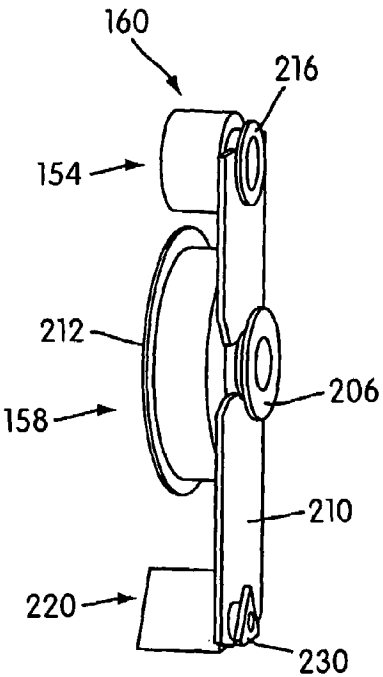
FIG. 27 is a rear perspective view of the cartridge of FIG. 24.

As shown in FIG. 26, the supply roll 158 has a central hub 204 upon which the liner 200 is wound. One end of the hub 204 has a flange 206 slightly spaced apart therefrom to define a gap with a neck 209 therein that enables the hub 204 to be rotatably mounted to a cartridge body 210 in a manner to be described below. The opposite end of the hub 204 has a larger flange 212 that protects the axial face of the supply roll 158. The interior of the hub 204 is generally cylindrical. However, the illustrated supply roll 158 should not be considered limiting and it may have any suitable construction or configuration.

A take-up roll 154 has at least an end of the liner 200 connected thereto such that rotation of the take-up roll 154 winds the liner 200 thereon. This connection may be established in any suitable manner that enables rotation of the take-up roll 154 to wind the liner 200 thereon. The take-up roll 154 has a hub 214 upon which the liner 200 winds and a flange 216 similar to flange 206 on the supply roll hub 204. The flange 216 is spaced from the hub 214 and defines a gap with a neck 219 therein that enables the hub 214 to be rotatably mounted to the cartridge body 210 in a manner to be described below.

The cartridge body 210 connects the supply roll 158 and the take-up roll 154. Specifically, in the illustrated embodiment shown in FIG. 28, the cartridge body 210 is a plate-like member formed of cardboard, plastic, or any other suitable material. Three notches 222, 224, 226 are formed in the upper, side, and lower edges, respectively, of the cartridge body 210. The take-up roll 154 is rotatably mounted to the notch 222 on the upper edge, the supply roll 158 is mounted to the notch 224 on the side edge, and an applicator head 220, discussed below and over which the liner 200 is trained, is pivotally mounted to the notch 226 on the lower edge. The take-up roll 154 rotatably mounts to the notch 222 by the neck 219 engaging within the notch 222 and the portion of the body 210 defining the notch 222 being received between the flange 216 and the hub 214. The supply roll 158 rotatably mounts to the notch 224 by the neck 209 engaging within the notch 224 and the portion of the body 210 defining the notch 224 being received between the flange 206 and the hub 204.

The cartridge 160 further includes the applicator head 220. The head 220 has a flange 230 spaced therefrom to define a gap with a neck 232 therein. The head pivotally mounts to the notch 226 by the neck 232 engaging within the notch 226 and the portion of the body 210 defining the notch 226 being received between the flange 230 and the head 220. The head 220 has at least two transfer surfaces. These transfer surfaces include: (a) a definite length transfer surface 234 configured to engage the liner 200 opposite the adhesive and apply a definite length of adhesive from the liner 200 to a target substrate and (b) an indefinite length transfer surface 236 configured to apply an indefinite length of adhesive from the liner 200 to a target substrate. As shown, the applicator head 220 has three sides joined by corners to form a generally triangular configuration. One of the three sides is the definite length transfer surface 234 and the corner opposite that surface provides the indefinite length transfer surface 236. In the illustrated embodiment, the corner providing the indefinite length transfer surface 236 is slightly rounded. It should be understood, however, that the applicator head 220 may have any suitable construction or configuration and may be mounted directly or indirectly to the cartridge body 210 in any suitable manner.

To enable the cartridge 160 to be used in various types of devices, the applicator head is movable between different positions. In the illustrated embodiment, the applicator head 220 is movable by pivoting to a definite length transfer position (shown in FIGS. 12–15) having the liner 200 trained over the definite length transfer surface 234 and enabling the cartridge 160 to be removably mounted in an operative position to a definite length adhesive transfer device 30 for transferring adhesive to the target substrate. This position enables the definite length transfer surface 234 of the applicator head 220 to press a definite length portion of the liner 200 against the target substrate and transfer a definite length of adhesive thereto. The length of liner 200 pressed against the target substrate and the length of adhesive transfer thereto is generally defined by the length of the definite length transfer surface 234.

Similarly, the applicator head 220 may be pivoted to an indefinite length transfer position having the liner 200 trained over the indefinite length transfer surface 236 and enabling the cartridge 160 to be removably mounted in an operative position to an indefinite length transfer device 10 for transferring adhesive to the target substrate. This position enables the indefinite length transfer surface 236 of the applicator head 220 to press an indefinite length portion of the liner 200 against the target substrate and transfer an indefinite length of adhesive thereto.

It is understood that the specific designs of the heads 20*a*, 20*b*, 370 in both of the types of transfer devices 10, 30, 330 described above, may be altered so that they may receive the pivoting head-type cartridge 160. Also, it is understood that the cartridge 60, 160 may have any construction or configuration, and the invention is not intended to be limited to the ones illustrated.

While preferred embodiments of the invention have been shown and described, it is evident that variations and modifications are possible that are within the spirit and scope of the preferred embodiments described herein.

It is understood that any references to directions are for convenience in viewing the figures and are not intended to characterize the devices as being used in any particular orientation, or as otherwise limiting.

What is claimed is:

1. A transfer device comprising:

a housing;

a supply roll rotatably mounted to the housing, the supply roll having a wound supply of liner wound thereon, the liner having an adhesive carrying surface with an adhesive provided thereon;

a take-up roll rotatably mounted to the housing, the take-up roll having at least an end portion of the liner connected thereto such that rotation of the take-up roll in a take-up direction winds portions of the liner unwound from the supply roll onto the take-up roll; and an application head comprising:

a plurality of rollers rotatable about substantially parallel axes spaced apart from one another; and a closed-loop belt trained about the plurality of rollers to provide a transfer surface facing outwardly of the device, the rotation of the rollers enabling the belt to travel around the rollers, a portion of the liner between the supply roll and the take-up roll being trained over the application head with the adhesive carrying surface facing outwardly of the device and the transfer surface of the belt engaging a backside surface of the liner opposite the adhesive carrying surface, the head being provided on the device to enable the adhesive to be transferred to a target substrate by engaging the adhesive carrying surface on the portion of the liner trained over the belt with the target substrate and applying pressure to bond the adhesive to the target substrate, and wherein the transfer device is a definite length transfer device and further comprises an advancer operatively connected to at least the take-up roll and configured to rotate the take-up roll in an indexing manner to affect the advancement of the liner so that after each advancement, a new portion of the liner is trained over the application head, the rotation of the take-up roll, the supply roll, and the plurality of rollers of the application head enabling advancement of the liner from the supply roll to the take-up roll with the belt traveling around the rollers of the application head to facilitate movement of the liner over the application head.

2. A transfer device according to claim 1, wherein the supply roll and the take-up roll are rotatably mounted on a removable cartridge body removably mounted to the housing.

3. A transfer device according to claim 1, wherein the belt comprises a silicone material.

4. A transfer device according to claim 1, wherein the plurality of rollers are substantially the same size and configuration.

5. A transfer device according to claim 1, wherein the surface of the belt comprises a material that is substantially the same as a material comprising the backside surface of the liner.

6. A transfer device according to claim 5, wherein the material comprising the surface of the belt and the material comprising the backside surface of the liner are both silicone.

7. A transfer device according to claim 1, further comprising a locator disposed at one end of the housing adjacent the application head so as to provide a locating surface for the device.

8. A transfer device according to claim 7, wherein the locator is biased in an inoperative position away from the device, the locator being positioned relative to the applicator head to enable the locating surface to be engaged with the target substrate when transferring the adhesive prior to engaging the adhesive carrying surface with the target substrate, the locator then being moveable inwardly relative to the application head so as to enable the head to thereafter engage the adhesive carrying surface.

9. A transfer device for use with a cartridge, the cartridge comprising a body with a longitudinal axis, a supply roll rotatably mounted to the body on the longitudinal axis, the supply roll comprising a wound length of liner having an adhesive carrying surface with an adhesive provided thereon, and a take-up roll rotatably mounted to the body on the longitudinal axis in spaced relation to the supply roll, the take-up roll having at least an end portion of the liner connected thereto such that rotation of the take-up roll in a take-up direction winds portions of the liner unwound from the supply roll onto the take-up roll, the transfer device comprising:

a housing defining a cartridge receiving space;

an extension member slidably connected to the housing for rectilinear movement relative to the housing along an extension axis; and a cartridge support slidably connected to the extension member for rectilinear movement relative to the extension member along the extension axis, the cartridge support being constructed to mount the cartridge thereon;

the cartridge support, the extension member, and the housing being constructed and arranged to enable the cartridge support and the extension member to be moved between (a) an extended position, wherein the extension member extends outwardly from the housing along the extension axis and the cartridge support extends outwardly from the extension member along the extension axis to enable the cartridge to be mounted to the cartridge support, and (b) a retracted position, wherein the extension member and the cartridge support are moved inwardly into the cartridge receiving space so that, when the cartridge is mounted to the cartridge support, the cartridge is moved into an operative position in the cartridge receiving space.

10. The transfer device of claim 9, further comprising:

an application head provided on the device to have a portion of the liner extending between the supply and take-up rolls of the cartridge trained thereover when the cartridge is in the operative position, the applicator head being provided to enable the adhesive to be transferred to a target substrate by engaging the adhesive carrying surface on the portion of the liner being trained over the head with the target substrate and applying pressure to bond the adhesive to the target substrate.

11. The transfer device of claim 10, wherein the application head is provided on the cartridge support.

12. The transfer device of claim 10, wherein the cartridge support includes (a) a cartridge support portion slidably connecting the cartridge support to the extension member for rectilinear movement along the extension axis as aforesaid, and (b) a head support portion slidably connected to the cartridge support portion for rectilinear movement relative to the cartridge support portion along the extension axis, the applicator head being provided on the head support portion, the rectilinear movement of the head support portion relative to the cartridge support portion along the extension axis enabling (a) the head to be moved outwardly relative to the cartridge support portion when the cartridge support and the extension member are in the extended position to facilitate mounting the cartridge to the cartridge support portion, and (b) the head to be moved inwardly relative to the cartridge support portion as the cartridge support and the extension member are moved to the retracted position with the cartridge on the cartridge support portion to facilitate engagement of the head with the portion of the liner extending between the supply roll and the take-up roll of the cartridge.

13. The transfer device of claim 12, wherein the head support portion has an end cap portion configured to engage the housing and form a part thereof when the extension member and the cartridge support are in the retracted position.

14. The transfer device of claim 13, wherein the housing has a cartridge receiving opening along the extension axis through which the extension member and the cartridge support are moved outwardly to the extended position and moved inwardly to the retracted position;

the end cap portion being complementary to the cartridge receiving opening to close the cartridge receiving opening when the extension member and the cartridge support are in the retracted position.

15. The transfer device of claim 9, wherein the cartridge support has an end cap portion configured to engage the housing and form a part thereof when the extension member and the cartridge support are in the retracted position.

16. The transfer device of claim 15, wherein the housing has a cartridge receiving opening along the extension axis through which the extension member and the cartridge support are moved outwardly to the extended position and moved inwardly to the retracted position;

the end cap portion being complementary to the cartridge receiving opening to close the cartridge receiving opening when the extension member and the cartridge support are in the retracted position.

17. The transfer device of claim 9, wherein the transfer device is an indefinite length transfer device.

18. The transfer device of claim 9, wherein the transfer device is a definite length transfer device and the transfer device further comprises an advancer operatively connected to at least the take-up roll so as to cause rotation of the take-up roll in an indexing manner.

19. A transfer device comprising:

a housing defining a cartridge receiving space;

a cartridge comprising:

a body with a longitudinal axis;

a supply roll rotatably mounted to the body on the longitudinal axis, the supply roll comprising a wound length of liner having an adhesive carrying surface with an adhesive provided thereon; and a take-up roll rotatably mounted to the body on the longitudinal axis in spaced relation to the supply roll, the take-up roll having at least an end portion of the liner connected thereto such that rotation of the take-up roll in a take-up direction winds portions of the liner unwound from the supply roll onto the take-up roll;

an extension member slidably connected to the housing for rectilinear movement relative to the housing along an extension axis; and a cartridge support slidably connected to the extension member for rectilinear movement relative to the extension member along the extension axis, the cartridge support being constructed to mount the cartridge thereon, the cartridge support, the extension member, and the housing being constructed and arranged to enable the cartridge support and the extension member to be moved between (a) an extended position wherein the extension member extends outwardly from the housing along the extension axis and the cartridge support extends outwardly from the extension member along the extension axis to enable the cartridge to be mounted to the cartridge support, and (b) a retracted position, wherein the extension member and the cartridge support are moved inwardly into the cartridge receiving space so that, when the cartridge is mounted to the cartridge support, the cartridge is moved into an operative position in the cartridge receiving space.

20. A transfer device comprising:

a housing;

a supply roll rotatably mounted to the housing, the supply roll having a wound supply of liner wound thereon, the liner having an adhesive carrying surface with an adhesive provided thereon;

a take-up roll rotatably mounted to the housing, the take-up roll having at least an end portion of the liner connected thereto such that rotation of the take-up roll in a take-up direction winds portions of the liner unwound from the supply roll onto the take-up roll, the supply roll and the take-up roll being rotatably mounted on a removable cartridge body removably mounted to the housing; and an application head comprising:

a plurality of rollers rotatable about substantially parallel axes spaced apart from one another; and a closed-loop belt trained about the plurality of rollers to provide a transfer surface facing outwardly of the device, the rotation of the rollers enabling the belt to travel around the rollers, a portion of the liner between the supply roll and the take-up roll being trained over the application head with the adhesive carrying surface facing outwardly of the device and the transfer surface of the belt engaging a backside surface of the liner opposite the adhesive carrying surface, the head being provided on the device to enable the adhesive to be transferred to a target substrate by engaging the adhesive carrying surface on the portion of the liner trained over the belt with the target substrate and applying pressure to bond the adhesive to the target substrate, and the rotation of the take-up roll, the supply roll, and the plurality of rollers of the application head enabling advancement of the liner from the supply roll to the take-up roll with the belt traveling around the rollers of the application head to facilitate movement of the liner over the application head.

21. A transfer device according to claim 20, wherein the belt comprises a silicone material.

22. A transfer device according to claim 20, wherein the plurality of rollers are substantially the same size and configuration.

23. A transfer device according to claim 20, wherein the surface of the belt comprises a material that is substantially the same as a material comprising the backside surface of the liner.

24. A transfer device according to claim 20, wherein the material comprising the surface of the belt and the material comprising the backside surface of the liner are both silicone.

25. A transfer device according to claim 20, wherein the transfer device is an indefinite length transfer device.

26. A transfer device according to claim 20, wherein the transfer device is a definite length transfer device and the transfer device further comprises an advancer operatively connected to at least the take-up roll and configured to rotate the take-up roll to affect the advancement of the liner.

27. A transfer device according to claim 26, further comprising a locator disposed at one end of the housing adjacent the application head so as to provide a locating surface for the device.

28. A transfer device according to claim 27, wherein the locator is biased in an inoperative position away from the device, the locator being positioned relative to the applicator head to enable the locating surface to be engaged with the target substrate when transferring the adhesive prior to engaging the adhesive carrying surface with the target substrate, the locator then being moveable inwardly relative to the application head so as to enable the head to thereafter engage the adhesive carrying surface.

29. A transfer device comprising:

a housing;

a supply roll rotatably mounted to the housing, the supply roll having a wound supply of liner wound thereon, the liner having an adhesive carrying surface with an adhesive provided thereon;

a take-up roll rotatably mounted to the housing, the take-up roll having at least an end portion of the liner connected thereto such that rotation of the take-up roll in a take-up direction winds portions of the liner unwound from the supply roll onto the take-up roll;

an application head comprising:

a plurality of rollers rotatable about substantially parallel axes spaced apart from one another; and a closed-loop belt trained about the plurality of rollers to provide a transfer surface facing outwardly of the device, the rotation of the rollers enabling the belt to travel around the rollers, a portion of the liner between the supply roll and the take-up roll being trained over the application head with the adhesive carrying surface facing outwardly of the device and the transfer surface of the belt engaging a backside surface of the liner opposite the adhesive carrying surface, the head being provided on the device to enable the adhesive to be transferred to a target substrate by engaging the adhesive carrying surface on the portion of the liner trained over the belt with the target substrate and applying pressure to bond the adhesive to the target substrate, and the rotation of the take-up roll, the supply roll, and the plurality of rollers of the application head enabling advancement of the liner from the supply roll to the take-up roll with the belt traveling around the rollers of the application head to facilitate movement of the liner over the application head, wherein the transfer device is an indefinite length transfer device.

30. A transfer device comprising:

a housing;

a supply roll rotatably mounted to the housing, the supply roll having a wound supply of liner wound thereon, the liner having an adhesive carrying surface with an adhesive provided thereon;

a take-up roll rotatably mounted to the housing, the take-up roll having at least an end portion of the liner connected thereto such that rotation of the take-up roll in a take-up direction winds portions of the liner unwound from the supply roll onto the take-up roll; and an application head comprising:

a plurality of rollers rotatable about substantially parallel axes spaced apart from one another; and a closed-loop belt trained about the plurality of rollers to provide a transfer surface facing outwardly of the device, the rotation of the rollers enabling the belt to travel around the rollers, a portion of the liner between the supply roll and the take-up roll being trained over the application head with the adhesive carrying surface facing outwardly of the device and the transfer surface of the belt engaging a backside surface of the liner opposite the adhesive carrying surface, the head being provided on the device to enable the adhesive to be transferred to a target substrate by engaging the adhesive carrying surface on the portion of the liner trained over the belt with the target substrate and applying pressure to bond the adhesive to the target substrate, wherein the transfer device is a definite length transfer device and further comprises an advancer operatively connected to at least the take-up roll and configured to rotate the take-up roll in an indexing manner to affect the advancement of the liner, and a locator disposed at one end of the housing adjacent the application head so as to provide a locating surface for the device, the rotation of the take-up roll, the supply roll, and the plurality of rollers of the application head enabling advancement of the liner from the supply roll to the take-up roll with the belt traveling around the rollers of the application head to facilitate movement of the liner over the application head.

31. A transfer device according to claim 30, wherein the locator is biased in an inoperative position away from the device, the locator being positioned relative to the applicator head to enable the locating surface to be engaged with the target substrate when transferring the adhesive prior to engaging the adhesive carrying surface with the target substrate, the locator then being moveable inwardly relative to the application head so as to enable the head to thereafter engage the adhesive carrying surface.

32. A transfer device for use with a cartridge, the cartridge comprising a body with a longitudinal axis, a supply roll rotatably mounted to the body on the longitudinal axis, the supply roll comprising a wound length of liner having an adhesive carrying surface with an adhesive provided thereon, and a take-up roll rotatably mounted to the body on the longitudinal axis in spaced relation to the supply roll, the take-up roll having at least an end portion of the liner connected thereto such that rotation of the take-up roll in a take-up direction winds portions of the liner unwound from the supply roll onto the take-up roll, the transfer device comprising:

a housing defining a cartridge receiving space;

an extension member slidably connected to the housing for rectilinear movement relative to the housing along an extension axis;

a cartridge support slidably connected to the extension member for rectilinear movement relative to the extension member along the extension axis, the cartridge support being constructed to mount the cartridge thereon, the cartridge support, the extension member, and the housing being constructed and arranged to enable the cartridge support and the extension member to be moved between (a) an extended position, wherein the extension member extends outwardly from the housing along the extension axis and the cartridge support extends outwardly from the extension member along the extension axis to enable the cartridge to be mounted to the cartridge support, and (b) a retracted position, wherein the extension member and the cartridge support are moved inwardly into the cartridge receiving space so that, when the cartridge is mounted to the cartridge support, the cartridge is moved into an operative position in the cartridge receiving space; and an application head having a portion of the liner extending between the supply and take-up rolls of the cartridge trained thereover when the cartridge is in the operative position, the applicator head being provided to enable the adhesive to be transferred to a target substrate by engaging the adhesive carrying surface on the portion of the liner being trained over the head with the target substrate and applying pressure to bond the adhesive to the target substrate, the application head comprising a plurality of rollers rotatable about substantially parallel axes spaced apart from one another; and a closed-loop belt trained about the plurality of rollers to provide a transfer surface facing outwardly of the device, the rotation of the rollers enabling the belt to travel around the rollers, the portion of the liner between the supply roll and the take-up roll being trained over the application head with the adhesive carrying surface facing outwardly of the device and the transfer surface of the belt engaging a backside surface of the liner opposite the adhesive carrying surface, and the rotation of the take-up roll, the supply roll, and the plurality of rollers of the application head enabling advancement of the liner from the supply roll to the take-up roll with the belt traveling around the rollers of the application head to facilitate movement of the liner over the application head.

* * * * *